US009281574B2

(12) United States Patent
Kawamura et al.

(10) Patent No.: US 9,281,574 B2
(45) Date of Patent: Mar. 8, 2016

(54) CRIMP TERMINAL, CONNECTION STRUCTURAL BODY, CONNECTOR, WIRE HARNESS, METHOD OF MANUFACTURING CRIMP TERMINAL, AND METHOD OF MANUFACTURING CONNECTION STRUCTURAL BODY

(71) Applicants: FURUKAWA ELECTRIC CO., LTD., Tokyo (JP); FURUKAWA AUTOMOTIVE SYSTEMS INC., Inukami-gun (JP)

(72) Inventors: Yukihiro Kawamura, Inukami-gun (JP); Takashi Tonoike, Inukami-gun (JP); Saburo Yagi, Tokyo (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/520,466

(22) Filed: Oct. 22, 2014

(65) Prior Publication Data

US 2015/0064991 A1 Mar. 5, 2015

Related U.S. Application Data

(63) Continuation of application No. PCT/JP2013/071419, filed on Aug. 7, 2013.

(30) Foreign Application Priority Data

Aug. 7, 2012 (JP) ..... 2012-174543

(51) Int. Cl.
*H01R 4/10* (2006.01)
*H01R 4/18* (2006.01)
(Continued)

(52) U.S. Cl.
CPC ..... *H01R 4/183* (2013.01); *H01R 4/029* (2013.01); *H01R 4/20* (2013.01); *H01R 4/70* (2013.01);
(Continued)

(58) Field of Classification Search
CPC ..... H01R 4/20; H01R 4/188; H01R 4/183; H01R 4/185
USPC ..... 439/879, 874, 891, 866
See application file for complete search history.

(56) References Cited

U.S. PATENT DOCUMENTS 3,955,044 A * 5/1976 Hoffman et al. ..... 174/84 C
4,274,701 A 6/1981 Bannert et al.
(Continued)

FOREIGN PATENT DOCUMENTS

CN 1328361 A 12/2001
CN 101151769 A 3/2008
(Continued)

OTHER PUBLICATIONS

Translation of International Search Report for PCT/JP2013/071419 dated Nov. 12, 2013.
(Continued)

*Primary Examiner* — Abdullah Riyami
*Assistant Examiner* — Vladimir Imas
(74) *Attorney, Agent, or Firm* — Oblon, McClelland, Maier & Neustadt, L.L.P.

(57) ABSTRACT

A crimp terminal includes a pressure-bonding section to which at least a conductor tip of an insulated wire is connected by pressure bonding, the insulated wire in which a conductor is covered with an insulating cover and an insulating cover on a tip side is peeled to expose the conductor to obtain the conductor tip, and a terminal connection section to which another connection terminal is allowed to be connected. The terminal connection section and the pressure-bonding section are configured as different parts, and a connection section in which the terminal connection section and the pressure-bonding section are connected in series in the order named from a tip side to a rear side in a long length direction is configured.

17 Claims, 20 Drawing Sheets

(51) Int. Cl.

| | |
|---|---|
| ***H01R 4/02*** | (2006.01) |
| ***H01R 4/20*** | (2006.01) |
| ***H01R 4/70*** | (2006.01) |
| ***H01R 43/00*** | (2006.01) |
| ***H01R 9/11*** | (2006.01) |
| ***H01R 43/02*** | (2006.01) |
| *H01R 4/62* | (2006.01) |
| *H01R 13/11* | (2006.01) |

(52) U.S. Cl.
CPC ..... *H01R 9/11* (2013.01); *H01R 43/005* (2013.01); *H01R 43/0221* (2013.01); *H01R 4/62* (2013.01); *H01R 13/11* (2013.01)

(56) References Cited

U.S. PATENT DOCUMENTS

| | | | | |
|---|---|---|---|---|
| 6,334,798 | B1 * | 1/2002 | Ushijima et al. | 439/879 |
| 7,174,633 | B2 * | 2/2007 | Onuma | 29/854 |
| 7,338,334 | B2 * | 3/2008 | Kumakura | 439/866 |
| 7,442,097 | B2 * | 10/2008 | Kumakura | 439/866 |
| 7,905,755 | B1 * | 3/2011 | Martauz | 439/877 |
| 8,485,853 | B2 * | 7/2013 | Seifert et al. | 439/882 |
| 8,622,774 | B2 * | 1/2014 | Seifert et al. | 439/882 |
| 8,802,987 | B2 * | 8/2014 | Morikawa et al. | 174/74 R |
| 8,826,533 | B2 * | 9/2014 | Seifert et al. | 29/857 |
| 8,963,006 | B2 * | 2/2015 | Kuwayama et al. | 174/84 C |
| 8,974,258 | B2 * | 3/2015 | Mitose et al. | 439/877 |
| 8,998,659 | B2 * | 4/2015 | Sato et al. | 439/877 |
| 9,033,751 | B2 * | 5/2015 | Sato | 439/877 |
| 2004/0142607 | A1 | 7/2004 | Asakura et al. | |
| 2006/0205289 | A1 * | 9/2006 | Kumakura | 439/866 |
| 2009/0229880 | A1 | 9/2009 | Watanabe | |
| 2013/0045644 | A1 * | 2/2013 | Aoki et al. | 439/878 |

FOREIGN PATENT DOCUMENTS

| | | | |
|---|---|---|---|
| CN | 102185185 | A | 9/2011 |
| JP | 3019822 | U | 10/1995 |
| JP | 2004-71437 | A | 3/2004 |
| JP | 2004-111058 | A | 4/2004 |
| JP | 2004-192948 | A | 7/2004 |
| JP | 2006-179369 | A | 7/2006 |
| JP | 2006-269150 | A | 10/2006 |
| WO | WO 2006/106971 | | 10/2006 |

OTHER PUBLICATIONS

Office Action issued Dec. 24, 2013 in Japanese Patent Application No. 2013-544903, with English translation.

Office Action issued Mar. 18, 2015 in Chinese Patent Application No. 201380007920.X, with English translation.

Search Report issued Aug. 7, 2014 in Chinese Patent Application No. 201380007920.X, with English translation.

Decision to Grant a Patent issued Mar. 17, 2014 in Japanese Patent Application No. 2013-544903, with English translation.

Decision to Grant a Patent issued Nov. 21, 2014 in Korean Patent Application No. 10-2014-7022392, with English translation.

Decision to Grant a Patent issued Jul. 27, 2015 in Chinese Patent Application No. 201380007920.X, with English translation.

* cited by examiner

CRIMP TERMINAL, CONNECTION STRUCTURAL BODY, CONNECTOR, WIRE HARNESS, METHOD OF MANUFACTURING CRIMP TERMINAL, AND METHOD OF MANUFACTURING CONNECTION STRUCTURAL BODY

CROSS-REFERENCE TO RELATED APPLICATIONS

This application is a continuation application of PCT International Application No. PCT/JP2013/071419 filed Aug. 7, 2013, which claims priority to Japanese Application No. 2012-174543 filed Aug. 7, 2012, both of which are herein incorporated by reference in their entirety for all purposes.

TECHNICAL FIELD

The present invention relates to a crimp terminal and a connection structural body that are fitted on a connector or the like of, for example, an automobile wire harness, a connector, and a method of manufacturing a connection structural body.

BACKGROUND ART

An electric appliance fitted on an automobile or the like is connected to another electric appliance and a power supply device through a wire harness obtained by bundling insulated wires to configure an electric circuit. At this time, the wire harness and the electric appliance or the power supply device are connected such that connectors fitted thereon are connected to each other.

Various crimp terminals arranged on the connectors are proposed, and a wire connection terminal disclosed in Patent Document 1 is one of the crimp terminals.

On the wire connection terminal disclosed in Patent Document 1, a flat connection piece obtained by flattening out a front-half portion of a conductive metal pipe and a wire insertion cylindrical section connected to the connection piece are formed. A screw insertion hole is formed in the connection piece.

The wire connection terminal is to electrically connect a wire and a desired device to each other by fixing the connection piece on the device with a screw and inserting a core wire of the wire into the wire insertion cylindrical section.

In this case, an entire structure of the wire connection terminal disclosed in Patent Document 1 is formed integrally including the connection piece and the wire insertion cylindrical section by processing a conductive metal pipe. For this reason, the connection piece connected to a device and the wire insertion cylindrical section connected to the core wire of the wire are made of the same material to have the same thickness.

However, when the entire wire connection terminal is integrally manufactured by one member, in spite of that fact that a connection piece connected to a device and a wire insertion cylindrical section connected to the core wire of the wire are required to have different functions such as water-blocking performance and strength and different levels thereof, the connection piece and the wire insertion cylindrical section are restricted to be made of the same material and to have the same thickness, for example.

For example, the connection piece and the wire insertion cylindrical section are not always made of an appropriate material and do not always have an appropriate thickness, an appropriate shape, and the like such that required predetermined functions are satisfied. Desired functions required for the connection piece and the wire insertion cylindrical section are not completely satisfied.

When the wire connection terminal disclosed in Patent Document 1 is to be manufactured, one conductive metal pipe is used as a material to perform processing such that predetermined functions required for a connection piece and a wire insertion cylindrical section are satisfied. For this purpose, an advanced processing technique is required, and time and cost required for the processing increase. The connection piece and the wire insertion cylindrical section may not be able to be formed in desired shapes.

When the wire is bent, a heavy load may be applied especially to a boundary portion between the connection piece and the wire insertion cylindrical section. In order to increase the strength of the boundary portion between the parts, an entire thickness need to be increased, and a material cost disadvantageously increases.

In this manner, when the crimp terminal is integrally manufactured, a degree of freedom for design is restricted, and a problem in which portion of the crimp terminal such as a wire connection section, a pressure-bonding section, and a boundary portion therebetween cannot be formed while securing the desired functions is posed.

PRIOR ART DOCUMENT

Patent Document

Patent Document 1: Japanese Utility Model Registration No. 3019822

SUMMARY OF THE INVENTION

Problem to be Solved by the Invention

An object of the invention is to provide a crimp terminal, a connection structural body, a connector, a wire harness, a method of manufacturing a crimp terminal, and a method of manufacturing a connection structural body that have excellent degrees of freedom for design to make it possible to appropriately configure pressure-bonding sections and terminal connection sections depending on functions required therefor.

Solution to the Problem

The present invention provides a crimp terminal including a pressure-bonding section with which at least a conductor tip of an insulated wire is connected by pressure bonding, the insulated wire in which a conductor is covered with an insulating cover and the insulating cover on a tip side is peeled to expose the conductor to obtain the conductor tip, and a terminal connection section to which another connection terminal is allowed to be connected, wherein the pressure-bonding section is configured such that a plate material forms a sectional hollow shape, and the plate material in the sectional hollow shape is welded in a long length direction, on a one-end side of the pressure-bonding section in the long length direction in the sectional hollow shape, a sealing portion that seals the sectional hollow shape to planarly superpose the plate material is arranged, and welding is performed in a width direction between both ends of the sealing portion in the long length direction, the terminal connection section and the pressure-bonding section are configured as different parts, and a welding connection section in which the terminal connection section and the pressure-bonding section are connected by welding in series with each other in the order named from the tip side to a rear side in a long length direction is configured.

With the configuration, the crimp terminal can have an excellent degree of freedom for design that enables the pressure-bonding section and the terminal connection section to be appropriately configured depending on functions required for the pressure-bonding section and the terminal connection section.

This will be described in more detail. According to the above configuration, since the terminal connection section and the pressure-bonding section configured as different parts are connected to each other with the connection section, the terminal connection section and the pressure-bonding section can be made of materials different from each other or may be formed by performing a plating process.

Even when the terminal connection section and the pressure-bonding section have complicated shapes, the terminal connection section and the pressure-bonding section can be assembled by independently performing a punching process and a bending process. For this reason, even when the crimp terminal has a complicated shape as a whole, the crimp terminal can be formed.

In this manner, a degree of freedom for design of the crimp terminal can be considerably increased.

Even when the shape of the crimp terminal is complicated, the crimp terminal need not be formed in a complicated shape as a whole, and the terminal connection section and the pressure-bonding section can be independently formed. Consequently, for example, the cost for a mold to punch a material in a terminal shape can be reduced, and costs and work for manufacturing the entire crimp terminal can be reduced.

As to a means for connecting the terminal connection section and the pressure-bonding section, the connection can be performed with any one of means including, for example, welding, engagement, fitting, screw (pin) fastening, and compression bonding.

The pressure-bonding section may be made of a material depending on a conductor of a wire, and the terminal connection section can be made of a material depending on the material of another terminal or the like. For this reason, the pressure-bonding section and the terminal connection section may be made of different materials. In this case, galvanic corrosion does not easily occur, excellent conductivity can be obtained, and when a low-density material is selected, reduction in weight can be achieved.

As described above, the pressure-bonding section can be formed such that at least the conductor tip can be inserted from a proximal side and the pressure-bonding section has a hollow shape that can surround the conductor tip. According to the invention, the pressure-bonding section can be configured as a so-called closed-barrel terminal. For this reason, the pressure-bonding section can cause the conductor tip to be pressure-bonded from an entire circumferential direction thereof without forming a gap between the conductor tip and the outside.

Thus, since the pressure-bonding section can be brought into tight contact with the conductor tip, excellent conductivity can be obtained.

The conductive portion in the pressure-bonding section is not exposed to atmospheric air to make it possible to suppress the conductive portion from being deteriorated or deteriorated with age. Thus, corrosion does not easily occur in the conductive portion, and an electric resistance can be prevented from being increased by the corrosion. For this reason, stable conductivity can be obtained. That is, a stable electric connection state can be secured.

As described above, on the tip side in the long length direction of the pressure-bonding section, a sealing portion that seals the tip side can be arranged, and the pressure-bonding section can be formed in a continuous shape continuing on an entire circumferential direction from the pressure-bonding section to the sealing portion. According to the invention, in a pressure-bonding state in which the conductor portion is pressure-bonded with the pressure-bonding section, a one-end side in the long length direction of the pressure-bonding section having a hollow sectional shape is sealed to prevent moisture from entering the pressure-bonding section from the tip side in the long length direction so as to secure reliable water-blocking performance.

The sealing portion need not be formed for a closed-barrel terminal in a pre-pressure-bonding state, and may be formed for a terminal that is an open-barrel terminal in the pre-pressure-bonding state and, in a post-pressure-bonding state, is a closed-barrel terminal in which both barrel pieces on both sides in a width direction of a bottom surface of the barrel face each other to form a closed annular shape in the circumferential direction.

As described above, when the connection section is formed by the welding connection section in which the terminal connection section and the pressure-bonding section are connected to each other by welding, the terminal connection section and the pressure-bonding section can be tightly connected to each other to have excellent integrity.

Furthermore, when the terminal connection section and the pressure-bonding section are connected to each other by the welding connection section, both the sections can be tightly connected to each other. For this reason, the strength of a portion between the pressure-bonding section and the terminal connection section can be improved.

In addition, since metal components of metal base materials configuring the terminal connection section and the pressure-bonding section are melted and integrated with each other, an excellent electric connection can be obtained.

As an aspect of the invention, the welding can be performed by, for example, a laser beam obtained by a YAG laser, a semiconductor laser, a disk laser, or the like, an electronic beam, or the like. However, the welding is preferably performed by fiber laser welding.

According to the invention, a gap-free pressure-bonding section is configured to make it possible to reliably prevent moisture from entering the pressure-bonding section in a pressure-bonding state. The fiber laser welding can be focused on a minimal spot in comparison with other laser welding, can achieve laser welding at a high-power density, and can achieve continuous laser irradiation. Thus, welding having reliable water-blocking performance can be performed.

As an aspect of the invention, at facing portions where the pressure-bonding section and the terminal connection section face each other, orthogonal direction facing surfaces facing each other in an orthogonal direction orthogonal to both the long length direction and the width direction can be formed, and the welding connection section can be formed such that the orthogonal direction facing surfaces of the pressure-bonding section and the terminal connection section are superposed on each other and the superposed orthogonal direction facing surfaces are welded to each other.

With the configuration, the facing portions between the pressure-bonding section and the terminal connection section are superposed on each other in a surface contact state and welded to each other in the state to make it possible to tightly connect the pressure-bonding section and the terminal connection section to each other.

Since the orthogonal direction facing surfaces of the pressure-bonding section and the terminal connection section can be welded with each other in a stable arrangement state in which the orthogonal direction facing surfaces are superposed in a surface contact state, the pressure-bonding section and the terminal connection section can be welded to each other without being displaced from each other.

As an aspect of the invention, in the pressure-bonding section, a through hole that penetrates a base material configuring the pressure-bonding section in a thickness direction can be formed to make the conductor tip that is pressure-bonded by the pressure-bonding section visible from the outside.

With the above configuration, in a state in which the pressure-bonding section is pressure-bonded to the conductor tip, a condition in the pressure-bonding section can be visually checked from the outside of the pressure-bonding section. In this manner, it is possible to visually confirm a pressure-bonding state by the pressure-bonding section, for example, a conductor position in the pressure-bonding section can be visually confirmed.

Thus, a defective product can be excluded at a glance to make it possible to contribute to quality improvement.

As an aspect of the invention, of the pressure-bonding section in a pressure-bonding state in the circumferential direction, the facing portion facing the terminal connection section can be set as the orthogonal direction facing surface, and the through hole can be arranged in the orthogonal direction facing surface of the pressure-bonding section.

According to the configuration, the orthogonal direction facing surface having the through hole on the pressure-bonding section and the orthogonal direction facing surface on the terminal connection section can be welded to each other while being superposed on each other.

Thus, when welding is performed in the above aspect, the welding can be performed to close the through hole. For this reason, in a state in which the pressure-bonding section and the terminal connection section are connected to each other, moisture does not enter the pressure-bonding section through the through hole to make it possible to secure excellent water-blocking performance.

Furthermore, as described above, the through hole is arranged in the orthogonal direction facing surface on the pressure-bonding section to make it possible to perform two independent steps, i.e., the step of connecting the facing portions between the pressure-bonding section and the terminal connection section to each other by welding and the step of closing the through hole at a time.

In this manner, the productivity of crimp terminals having excellent water-blocking performance can be improved.

As an aspect of the invention, at the facing portions where the pressure-bonding section and the terminal connection section face each other, long length direction facing ends facing each other in the long length direction can be formed, and the welding connection section can be formed such that the long length direction facing ends of the pressure-bonding section and the terminal connection section are made to abut against each other and the abutted long length direction facing ends are welded to each other.

With the configuration, since the long length direction facing ends of the pressure-bonding section and the terminal connection section are welded to each other while being made to abut against each other, the base materials configuring the pressure-bonding section and the terminal connection section are not superposed on each other. For this reason, the pressure-bonding section and the terminal connection section can be compactly welded to each other without increasing the welded portion in volume.

As an aspect of the invention, at the facing portions where the pressure-bonding section and the terminal connection section face each other, the long length direction facing surfaces each having a facing area larger than a facing area between the long length direction facing ends can be formed, and the welding connection section can be formed such that the long length direction facing surfaces of the pressure-bonding section and the terminal connection section are made to abut against each other and the abutted long length direction facing surfaces are welded to each other.

With the above configuration, when the long length direction facing surfaces are made to abut against each other, a facing area larger that obtained when the long length direction facing ends are made to abut against each other can be secured.

Thus, welding can be firmly performed by welding large facing portions obtained by making the long length direction facing surfaces to abut against each other, and excellent integrity between the pressure-bonding section and the terminal connection section can be obtained.

The crimp terminal is not always be configured to have a configuration having any one set of the orthogonal direction facing surfaces, the long length direction facing ends, and the long length direction facing surfaces at the facing portions between the pressure-bonding section and the terminal connection section, may be configured to have a configuration having any combination of the orthogonal direction facing surfaces, the long length direction facing ends, and the long length direction facing surfaces, and can be configured to have at least one of the configurations.

As an aspect of the invention, at the facing portions where the pressure-bonding section and the terminal connection section face each other, a latching section that latches the facing portions with each other in a facing state can be formed, and the welding connection section can be formed in a latching state in which the facing portions are latched with each other by the latching section.

With the above configuration, since the facing portions between the pressure-bonding section and the terminal connection section can be welded to each other while being latched with each other, in welding between the facing portions, the pressure-bonding section and the terminal connection section can be smoothly welded to each other without being displaced from each other to have a correct shape in which the pressure-bonding section and the terminal connection section are arranged in series with each other.

The latching section may be configured to be combined to at least one set of the orthogonal direction facing surfaces, the long length direction facing ends, and the long length direction facing surfaces, and the latching section can be configured on at least one of the pressure-bonding section and the terminal connection section.

The latching section may be configured to perform, for example, latching by insertion, latching by bending a projecting piece, or latching between ends formed by bending in hooked shapes.

As an aspect of the invention, the conductor portion can be made of an aluminum-based material, and at least the pressure-bonding section of the terminal connection section and the pressure-bonding section can be made of a copper-based material.

According to the invention, a weight lower than that of an insulated wire having a conductive portion made of a copper wire can be achieved, the reliable water-blocking performance can prevent a metal surface forming the conductor of the insulated wire from being oxidized, and so-called dissimilar metal contact corrosion (to be referred to galvanic corrosion hereinafter) can be prevented.

This will be described in more detail. Connection between an insulated wire and a crimp terminal is generally performed by pressure-bonding joining in which pressure bonding is performed by caulking a pressure-bonding section on the crimp terminal at a conductor tip terminal of the insulated wire.

However, when moisture or the like adheres to the connection portion between the insulated wire and the crimp terminal, oxidization of a metal surface forming the conductor of the insulated wire progresses to increase the resistance of the connection portion.

When different metals are used in the conductor and the crimp terminal, galvanic corrosion disadvantageously progresses. The progress of corrosion in the metal materials at the connection portion causes cracking of the connection portion or a contact failure to inevitably adversely affect product life.

In particular, in recent years, for example, a wire harness using an aluminum alloy as a conductor of an insulated wire and using a copper alloy as a crimp terminal has been practically used, and the problem of corrosion at a connection portion has been conspicuous.

This will be described in more detail. When a copper-based material that has been conventionally used in a conductor portion of an insulated wire is replaced with an aluminum-based material such as aluminum or an aluminum alloy to pressure-bond the conductor portion made of the aluminum-based material to a crimp terminal, a phenomenon in which contact of the terminal material to a nobler metal material such as tin plating, gold plating, or a copper alloy corrodes the aluminum-based material that is a less noble metal, i.e., galvanic corrosion is a problem.

The galvanic corrosion is a phenomenon in which, when moisture adheres to a portion where the nobler metal material is in contact with the less noble metal, a corrosion electric current is generated to corrode, solve, and eliminate the less noble metal. The phenomenon corrodes, solves, and eliminates the aluminum-based conductor portion pressure-bonded to the pressure-bonding section of the crimp terminal to finally increase an electric resistance. As a result, a sufficient conductive function cannot be exerted.

However, the conductor portion is made of an aluminum-based material, and at least the pressure-bonding section of the terminal connection section and the pressure-bonding section is made of a copper-based material. Even in this case, the reliable water-blocking performance can be secured, and so-called galvanic corrosion can be prevented while the weight of the insulated wire is made smaller than that of an insulated wire having a conductor portion made of a copper-based material.

The present invention is a connection structural body in which the insulated wire and the crimp terminal are connected to each other by the pressure-bonding section in the crimp terminal described above.

According to the invention, since the pressure-bonding section and the terminal connection section can be tightly connected to each other by welding or the like, in a state in which the insulated wire and the crimp terminal are connected to each other, even if the insulated wire is bent or twisted to apply stress to the crimp terminal, the connection portions between the pressure-bonding section and the terminal connection section are not separated from each other or displaced from each other, and the excellent integrity of the crimp terminal can be secured.

The invention is a connector in which the crimp terminal described above is arranged in a connector housing.

According to the configuration, the facing portions between the pressure-bonding section and the terminal connection section are connected to each other to configure a crimp terminal, so that the pressure-bonding section and the terminal connection section are compactly assembled to make it possible to be connected to each other. With the configuration, in comparison with the case where a base material obtained by the pressure-bonding section and the terminal connection section integrally formed in advance configures a crimp terminal by bending or the like, the entire crimp terminal can be compactly configured even when the shape of the crimp terminal is complicated.

Thus, when the facing portions of the pressure-bonding section and the terminal connection section are connected to each other to configure a crimp terminal, the crimp terminal can be compactly configured as a whole. For this reason, a connector in which the crimp terminal can be tightly appropriately fixed to a fixing section of a connector housing can be configured.

The invention is a wire harness in which the crimp terminal of the connection structural body described above is arranged in plural in a connector housing.

According to the configuration, the facing portions between the pressure-bonding section and the terminal connection section are connected to each other to configure a crimp terminal, so that the pressure-bonding section and the terminal connection section can be compactly assembled and connected to each other. According to the configuration, in comparison with the case where a base material obtained by the pressure-bonding section and the terminal connection section integrally formed in advance configures a crimp terminal by bending or the like, the entire crimp terminal can be compactly configured even when the shape of the crimp terminal is complicated.

Thus, as described above, the facing portions between the pressure-bonding section and the terminal connection section are connected to each other to configure a crimp terminal, so that the crimp terminal can be compactly configured as a whole.

Therefore, a wire harness in which the crimp terminal is tightly appropriately fixed to the fixing section of the connector housing can be configured.

The invention provides a method of manufacturing a crimp terminal, the crimp terminal including a pressure-bonding section with which at least a conductor tip of an insulated wire is connected by pressure bonding, the insulated wire in which a conductor is covered with an insulating cover and the insulating cover on a tip side is peeled to expose the conductor to obtain the conductor tip, and a terminal connection section to which another connection terminal is allowed to be connected, the method including bending a plate material to configure a sectional hollow shape, and performing shape processing on a one-end side of the sectional hollow shape in a long length direction to have a sealing shape that seals the sectional hollow shape to planarly superpose the plate material, welding ends of the plate material configuring the sectional hollow shape to each other in the long length direction, performing welding in a width direction between both ends in the long length direction of a sealing portion processed to have the sealing shape to configure the pressure-bonding section, arranging the terminal connection section and the pressure-bonding section that are configured as different parts in series in the order named from the tip side to a rear side in a long length direction, and a welding step of integrally welding the terminal connection section and the pressure-bonding section to each other in a state in which the terminal connection section and the pressure-bonding section are connected to each other.

According to the welding step, since the facing portions between the terminal connection section and the pressure-bonding section are welded to each other, the terminal connection section and the pressure-bonding section can be tightly connected to each other.

As an aspect of the invention, welding for integrally connecting the terminal connection section and the pressure-bonding section to each other and welding performed in the width direction between both the ends of the sealing portion in the long length direction are performed at a time.

As an aspect of the invention, the welding step can be performed by fiber laser welding.

When the welding step is performed by the fiber laser welding, it is possible to configure a connection welding portion having reliable water-blocking performance as described above.

As an aspect of the invention, in the welding step in which long length direction facing ends facing each other in a long length direction are made to abut against each other at facing portions where the pressure-bonding section and the terminal connection section face each other and the abutted long length direction facing ends are welded to each other, the long length direction facing ends are irradiated with the laser from at least one side of the long length direction in the state in which the long length direction facing ends are made to abut against each other, and welding in which the long length direction facing ends are irradiated with the laser from a direction approximately equal to the long length direction can be performed while at least one of the laser and the long length direction facing ends is relatively moved to move the laser along the long length direction facing ends.

According to the configuration, while a laser irradiating section is moved along the long length direction facing ends, a laser is not brought into out-of-focus on the long length direction facing ends, and welding can be appropriately performed in an in-focus state.

Furthermore, while the laser irradiating section is moved along the long length direction facing ends, in order to focus the laser on the long length direction facing ends, a fiber laser irradiating section need not be made to approach and separate from the long length direction facing ends, and welding can be smoothly performed with a simple configuration.

In this case, as the method of manufacturing a crimp terminal, a method of directly irradiating the long length direction facing ends with a laser irradiated by the laser irradiating section may be employed when the long length direction facing ends are welded to each other by a laser.

More specifically, there can be given a method in which, in a state in which the long length direction facing ends are made to abut against each other, welding is performed such that the laser irradiating section is arranged at least one side of the long length direction with reference to the long length direction facing ends to irradiate the long length direction facing ends with the laser from the laser irradiating section in a direction approximately equal to the long length direction while the laser irradiating section is moved along the long length direction facing ends.

However, the method of manufacturing a crimp terminal according to the present invention is not limited to a method in which the long length direction facing ends are directly irradiated with a laser irradiated by the laser irradiating section, and may be a method in which the long length direction facing ends are indirectly irradiated with a laser irradiated by the laser irradiating section.

For example, a laser irradiated from the laser irradiating section may be reflected by a reflecting means such as a mirror once, and the long length direction facing ends may be irradiated with the reflected laser to be welded.

The welding in which the long length direction facing ends are irradiated with the laser in the direction approximately equal to the long length direction is not limited to the method of moving only the laser along the long length direction facing ends, and may be performed by moving only the long length direction facing ends or moving both the laser and the long length direction facing ends.

The invention provides a method of manufacturing a connection structural body, the method including a pressure-bonding step of connecting the conductor tip to the pressure-bonding section by pressure bonding performed before the welding step performed in the method of manufacturing a crimp terminal.

According to the manufacturing method described above, the pressure-bonding step is performed before the welding step to make it possible to pressure-bond the pressure-bonding section to the conductor tip before the terminal connection section and the pressure-bonding section are connected to each other.

In this manner, the many pressure-bonding sections in each of which the conductor tip is pressure-bonded even in the state in which the terminal connection section is not connected can be arranged.

Thus, regardless of whether the terminal connection section is, for example, a male terminal or a female terminal, the terminal can be connected to the pressure-bonding section. For this reason, when any one of the terminals is only connected, the resultant wire can be used as a wire to which the male terminal is connected or a wire to which the female terminal is connected, and a wire having good versatility can be obtained. Furthermore, according to the configuration, when the terminal connection section is, for example, a terminal fitting section connected to another terminal by fitting, the sizes of terminal fitting sections can be freely changed and combined to each other.

In the case in which the pressure-bonding section is pressure-bonded to a conductor tip before the terminal connection section and the pressure-bonding section are connected to each other, the pressure-bonding step can be efficiently performed without being disturbed by the terminal connection section when the pressure-bonding section is pressure-bonded to the conductor tip.

Furthermore, in the case in which the pressure-bonding section is pressure-bonded to the conductor tip before the terminal connection section and the pressure-bonding section are connected to each other, impact or the like caused by pressure bonding when the pressure-bonding section is pressure-bonded to the conductor tip is not transferred to the connection portions between the terminal connection section and the pressure-bonding section. For this reason, the impact or the like caused by pressure bonding does not separate the connection portions between the terminal connection section and the pressure-bonding section from each other or deform the connection portions, and the terminal connection section and the pressure-bonding section can be tightly pressure-bonded to each other.

Effect of the Invention

According to the present invention, a crimp terminal, a connection structural body, a connector, a wire harness, a method of manufacturing a crimp terminal, and a method of manufacturing a connection structural body each having an excellent degree of freedom for design that enables a pressure-bonding section and a terminal connection section to be appropriately configured depending on functions required therefor can be provided.

EMBODIMENTS OF THE INVENTION

An embodiment of the invention will be described below with reference to the accompanying drawings.

First Embodiment

Figure 1A:
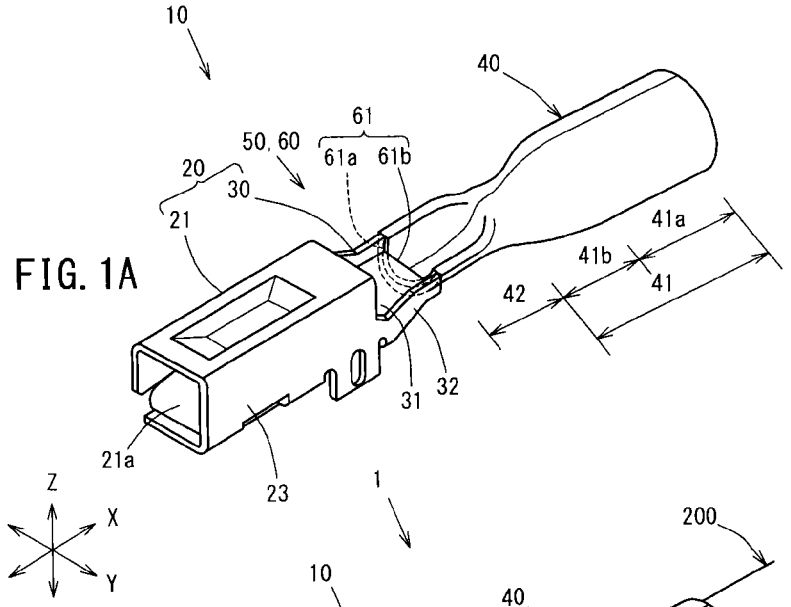
FIGS. 1A and 1B are perspective views of a female crimp terminal and a crimp terminal-bearing wire according to a first embodiment.
Figure 1B:
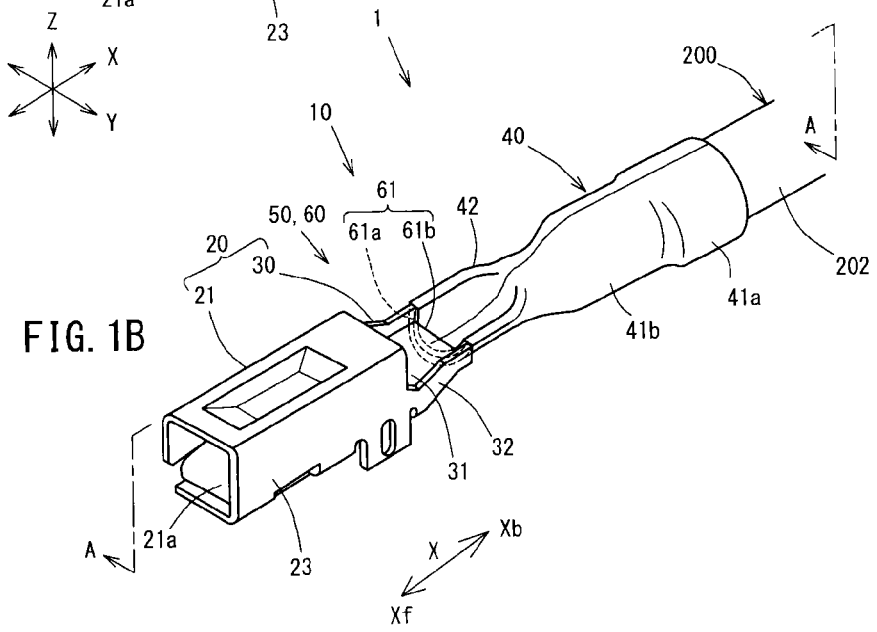

FIG. 1A is a perspective view of a female crimp terminal 10 according to a first embodiment, and FIG. 1B is a perspective view of a crimp terminal-bearing wire 1 according to the first embodiment.

Figure 2:
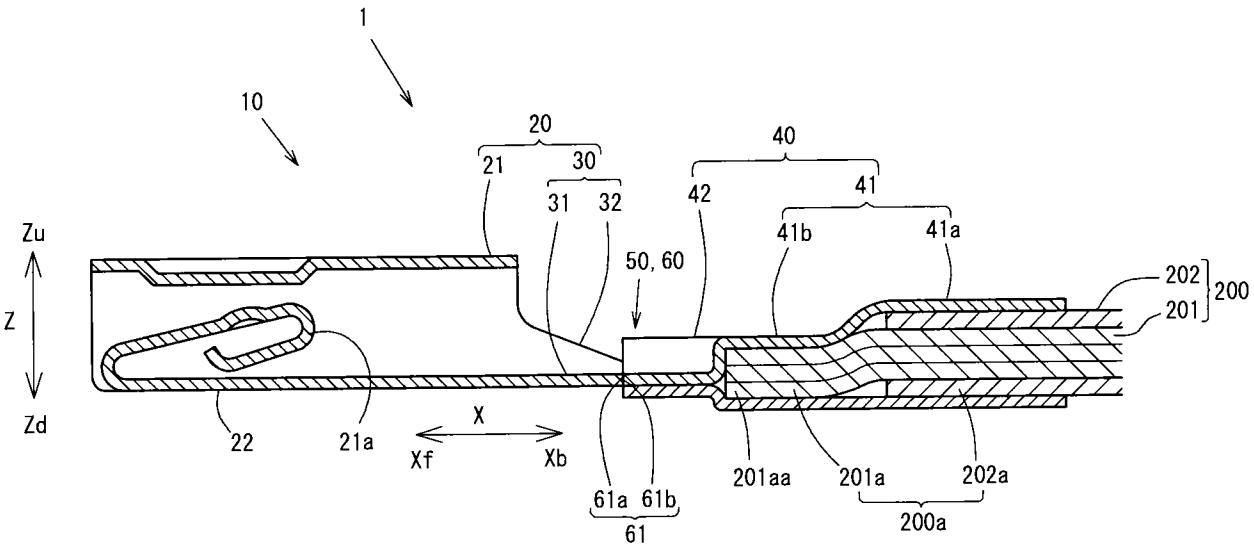
FIG. 2 is a sectional view of the crimp terminal-bearing wire according to the first embodiment.

FIG. 2 is a longitudinal sectional view of an intermediate portion of the crimp terminal-bearing wire 1 according to the first embodiment in a width direction, and is a sectional view along A-A line in FIG. 1B.

The crimp terminal-bearing wire 1 according to the embodiment, as shown in FIG. 1B and FIG. 2, is configured by connecting an insulated wire 200 to the female crimp terminal 10. This will be described in more detail. A wire tip 200*a* of the insulated wire 200 is connected to a pressure-bonding section 40 of the female crimp terminal 10 by pressure bonding.

The insulated wire 200 pressure-bonded to the female crimp terminal 10 is configured such that an aluminum core wire 201 obtained by bundling aluminum raw wires 201*aa* is coated with an insulating cover 202 made of an insulating resin. This will be described in more detail. The aluminum core wire 201 is configured such that aluminum alloy wires are twisted to have a cross-section of 0.75 $mm^2$. However, the present invention is not limited to the configuration.

The wire tip 200*a* is a part in which an insulated tip 202*a* and a conductor tip 201*a* are arranged in series toward a tip side in the order named at a tip portion of the insulated wire 200.

The conductor tip 201*a* is a portion in which the insulating cover 202 on the front side of the insulated wire 200 is peeled to expose the aluminum core wire 201. The insulated tip 202*a* is a tip portion of the insulated wire 200. However, the insulated tip 202*a* is a portion on the rear side of the conductor tip 201*a*, and is a portion obtained by coating the aluminum core wire 201 with the insulating cover 202.

The female crimp terminal 10 will be described in more detail below.

The female crimp terminal 10, as shown in FIGS. 1A and 1B and FIG. 2, is configured such that a terminal connection section 20 and the pressure-bonding section 40 are arranged in series from a front side serving as a tip side of a long length direction X to a rear side serving as a proximal side and the terminal connection section 20 and the pressure-bonding section 40 are integrally connected to each other by a welding connection section 50.

The long length direction X, as shown in FIG. 1B, is a direction equal to the long length direction of the insulated wire 200 to which the pressure-bonding section 40 is pressure-bonded, and the width direction Y corresponds to the width direction of the female crimp terminal 10 that traverses the long length direction X in planar directions. A box section 21 side of the pressure-bonding section 40 is defined as a front side (tip side). In contrast to this, a pressure-bonding section 40 side of the box section 21 is defined as a rear side (proximal side).

In a state in which the female crimp terminal 10 is arranged as shown in FIG. 2, an upper direction in FIG. 2 is set as an upper direction Zu, and a lower direction is set as a lower direction Zd.

The terminal connection section 20 is integrally configured by the box section 21 into which an insertion tab on a male terminal (not shown) is allowed to be inserted and a transition section 30.

The box section 21 is configured by an upside-down hollow quadratic prism. In the box section 21, an elastic contact piece 21*a* is arranged to be in contact with an insertion tab (not shown) of a male connector to be inserted, the elastic contact piece 21*a* bent toward the rear side in the long length direction X.

In the embodiment, as described above, the crimp terminal is configured by the female crimp terminal 10 including the terminal connection section 20 and the pressure-bonding section 40. However, as long as a crimp terminal has the pressure-bonding section 40, the crimp terminal may be a male crimp terminal including the pressure-bonding section 40 and an insertion tab inserted into and connected to the box section 21 in the terminal connection section 20 of the female crimp terminal 10 described above or a crimp terminal including only the pressure-bonding section 40 to bundle and connect the aluminum core wires 201 of the plurality of insulated wires 200.

The transition section 30 projects with a predetermined length from the rear end of the box section 21 and is formed by a transition bottom 31 and side walls 32 projecting upward from both sides of the transition bottom 31 in the width direction Y. The transition section 30 need not be arranged on the terminal connection section 20. The transition section 30 may be arranged on the tip side of the pressure-bonding section 40 to project toward the terminal connection section 20, the transition sections 30 may be arranged on both the terminal connection section 20 and the pressure-bonding section 40, or the transition section 30 may be arranged as a part of the welding connection section 50 (will be described later) that connects the terminal connection section 20 and the pressure-bonding section 40.

The box section 21 having a hollow quadratic prism shape is configured such that the side surfaces 23 continuously formed on both the sides of the bottom 22 in the width direction Y orthogonal to the long length direction X are bent to be superposed on each other in an approximately rectangular shape when viewed from the tip side in the long length direction X.

In the pressure-bonding section 40, a wire pressure-bonding section 41 and a sealing portion 42 are arranged in the order named from the rear side to the front side and integrally formed in a continuous shape continuing all over the circumferential direction.

In the sealing portion 42, an end on the front side of the wire pressure-bonding section 41 is deformed to be flattened out in an approximately flat shape, the internal surfaces of plate-like terminal materials 100 configuring the female crimp terminal 10 are superposed on each other to be brought into tight contact with each other, and an orthogonal section orthogonal to the long length direction X has an approximate U-shape.

In the wire pressure-bonding section 41, a cover pressure-bonding section 41*a* and a conductor pressure-bonding section 41*b* are continuously arranged in series in the order named from the rear side to the front side.

The wire pressure-bonding section 41 is configured by a hollow shape (cylindrical shape) in which an opening only on the rear side enables the wire tip 200*a* to be inserted into the opening, and no opening is formed on the tip side in the long length direction X and in the entire peripheral surface.

The cover pressure-bonding section 41*a* is a section corresponding to an arrangement portion of the insulated tip 202*a* in the long length direction X of the wire pressure-bonding section 41 in the state in which the wire tip 200*a* is inserted into the wire pressure-bonding section 41, and is formed in a hollow shape that can surround the insulated tip 202*a*.

The conductor pressure-bonding section 41*b* is a section corresponding to an arrangement portion of the conductor tip 201*a* of the wire pressure-bonding section 41 in the long length direction X in a state in which the wire tip 200*a* is inserted into the wire pressure-bonding section 41, and is formed in a hollow shape that can surround the conductor tip 201*a*.

The cover pressure-bonding section 41*a* and the conductor pressure-bonding section 41*b* are formed in cylindrical shapes having diameters approximately equal to each other in a pre-pressure-bonding state.

The welding connection section 50 is a connection section that integrally connects the terminal connection section 20 and the pressure-bonding section 40 by welding at a boundary portion between the terminal connection section 20 and the pressure-bonding section 40 in the long length direction X.

This will be described in more detail. At facing portions 60 where the pressure-bonding section 40 and the terminal connection section 20 face each other, long length direction facing ends 61 (61*a* and 61*b*) facing in the long length direction X are formed.

The long length direction facing end 61*a* in the pressure-bonding section 40 forms an approximate U-shape in a rear view in the long length direction X. The long length direction facing end 61*b* in the terminal connection section 20 is formed in an approximately flat shape that is long in the width direction Y in a front view in the long length direction X.

Subsequently, a method of manufacturing the female crimp terminal 10 described above will be described with reference to FIGS. 3A and 3B.

Figure 3A:
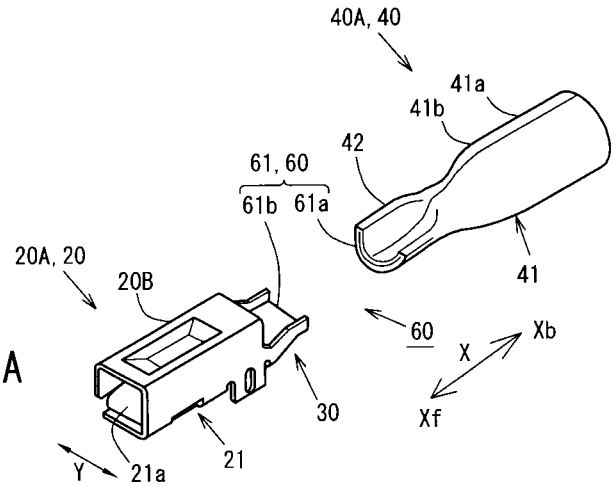
FIGS. 3A and 3B are diagrams for explaining a method of manufacturing a female crimp terminal.
Figure 3B:
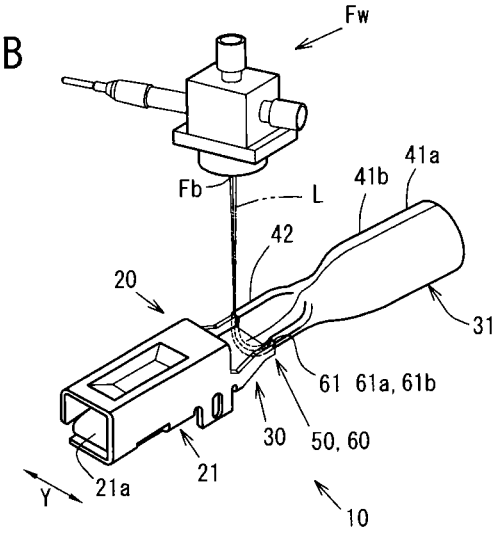

FIGS. 3A and 3B are diagrams for explaining a method of manufacturing a female crimp terminal. This will be described in more detail. FIG. 3A shows a state in which the pressure-bonding section 40 and the terminal connection section 20 configured by different members are arranged to be opposed to each other. FIG. 3B shows a manner in which the pressure-bonding section 40 and the terminal connection section 20 configured by different members are connected to each other by welding.

The female crimp terminal 10 is configured by two different members including a terminal connection section configuring member 20A corresponding to the terminal connection section 20 of the female crimp terminal 10 and a pressure-bonding section configuring member 40A corresponding to the pressure-bonding section 40.

The terminal connection section configuring member 20A is configured by a plate-like terminal connection section configuring material (not shown) formed in a developed shape obtained by developing the terminal connection section 20, and is configured such that the terminal connection section configuring material is bent in a three-dimensional shape having the box section 21 having a hollow quadratic prism shape.

The pressure-bonding section configuring member 40A is configured by a plate-like pressure-bonding section configuration material (not shown) formed in a developed shape obtained by developing the pressure-bonding section 40, and is configured in an approximately cylindrical closed-barrel shape that has an opening on a rear side in the long length direction X and is formed such that the pressure-bonding section configuring material is bent in a cylindrical shape, facing ends of the pressure-bonding section configuring material bent in the cylindrical shape are welded to each other by a laser L to form an O-shape in the rear view, and a portion corresponding to the sealing portion 42 formed at the front end in the long length direction X is flattened out with a mold.

The terminal connection section configuring material and the pressure-bonding section configuring material are plate-like materials to configure the female crimp terminal 10, and are made of a copper alloy strip (not shown) such as brass with the surface plated with tin (Sn plating).

As shown in FIG. 3A, the terminal connection section configuring member 20A and the pressure-bonding section configuring member 40A configured as different parts are arranged in series in the order named from a tip side Xf to a rear side Xb in the long length direction X.

In this state, a welding step of integrally welding the terminal connection section 20 and the pressure-bonding section 40 that are connected to each other is performed.

This will be described in more detail. As shown in FIG. 3B, the terminal connection section configuring member 20A and the pressure-bonding section configuring member 40A configured as different parts are arranged in series in the order named from the tip side to the rear side in the long length direction X, and the long length direction facing ends 61*a* and 61*b* of the pressure-bonding section 40 and the terminal connection section 20 are made to abut against each other. The terminal connection section 20 and the pressure-bonding section 40 are irradiated with a laser L from a laser irradiating section Fb of a fiber laser welding device Fw arranged on, for example, the upper side Zu while the fiber laser welding device Fw is moved along the long length direction facing ends 61*a* and 61*b* with reference to the entire butt portions where the long length direction facing ends 61*a* and 61*b* are made to abut against each other so as to weld the long length direction facing ends 61*a* and 61*b* of the pressure-bonding section 40 and the terminal connection section 20.

With the above configuration, the terminal connection section 20 and the pressure-bonding section 40 can be integrally connected to each other, and the female crimp terminal 10 can be manufactured.

Subsequently, procedures for a method of manufacturing the crimp terminal-bearing wire 1 manufactured by pressure-bonding the female crimp terminal 10 to the wire tip 200*a* will be described with reference to FIG. 4.

Figure 4:
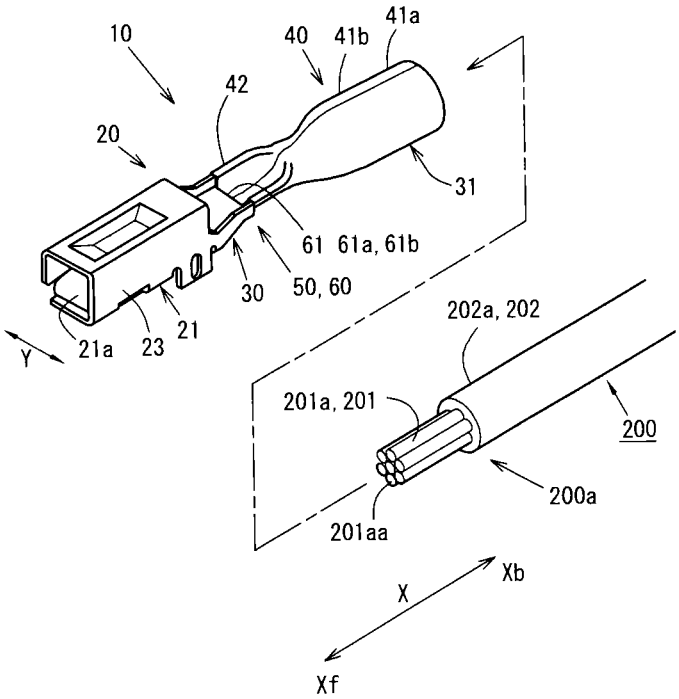
FIG. 4 is a diagram for explaining a method of manufacturing a crimp terminal-bearing wire.

FIG. 4 is a diagram for explaining the method of manufacturing the crimp terminal-bearing wire 1, and shows a manner immediately before the wire tip 200*a* is pressure-bonded to the pressure-bonding section 40 of the female crimp terminal 10.

First, as shown in FIG. 4, the wire tip 200*a* is inserted into the wire pressure-bonding section 41 in the pressure-bonding section 40. At this time, the insulated tip 202*a* of the wire tip 200*a* is inserted into the cover pressure-bonding section 41*a*, and the conductor tip 201*a* of the wire tip 200*a* is inserted into the conductor pressure-bonding section 41*b*.

At this time, the wire tip 200*a* is inserted deeply into the conductor pressure-bonding section 41*b*.

In this state, the wire pressure-bonding section 41 is pressure-bonded to the wire tip 200*a* with a pressure-bonding tool (not shown) such as a crimper.

In this manner, as shown in FIG. 2, the female crimp terminal 10 can be connected to the wire tip 200*a* by pressure bonding.

As described above, the crimp terminal-bearing wire 1 can be manufactured.

Functional effects exerted by the female crimp terminal 10, the crimp terminal-bearing wire 1, and the method of manufacturing a crimp terminal-bearing wire will be described below.

In the female crimp terminal 10 on the crimp terminal-bearing wire 1, the terminal connection section 20 and the pressure-bonding section 40 are configured as different parts by the terminal connection section configuring member 20A and the pressure-bonding section configuring member 40A, respectively, and the welding connection section 50 that connects the terminal connection section 20 and the pressure-bonding section 40 in series in the order named from the tip side to the rear side in the long length direction X is configured.

According to the configuration described above, the terminal connection section 20 and the pressure-bonding section 40 configured as different parts are connected by the welding connection section 50. For this reason, the terminal connection section 20 and the pressure-bonding section 40 can be made of materials different from each other or can be easily formed by performing different plating processes.

Since the terminal connection section 20 and the pressure-bonding section 40 can be assembled by independently performing punching processes and bending processes, the terminal connection section 20 and the pressure-bonding section 40 can be formed smoothly more than the terminal connection section 20 and the pressure-bonding section 40 formed at a time as the entire female crimp terminal 10. In addition, even when the shapes of the sections are further complicated, the terminal connection section 20 and the pressure-bonding section 40 can be accurately and easily formed.

In the embodiment, although the pressure-bonding section 40 and the terminal connection section 20 are made of a copper alloy, since the pressure-bonding section 40 and the terminal connection section 20 are formed as different members, the pressure-bonding section 40 and the terminal connection section 20 can be made of different materials.

For example, the pressure-bonding section 40 is made of, for example, an aluminum-based metal depending on the material of the aluminum core wire 201 of the insulated wire 200, and the terminal connection section 20 is made of a copper-based metal depending on the material of a male crimp terminal or the like to make it possible to obtain the terminal connection section 20 and the pressure-bonding section 40 in which galvanic corrosion does not easily occur and excellent conductivity is achieved.

Even when the shape of the female crimp terminal 10 is complicated, the entire female crimp terminal 10 need not be formed at a time as the complicated shape, and the terminal connection section 20 and the pressure-bonding section 40 can be independently formed. For this reason, consequently, for example, the cost of a mold to punch out a material in a terminal shape can be reduced, so that the work and cost for manufacturing the female crimp terminal 10 as a whole can be reduced.

Thus, as described above, a degree of freedom for design of the female crimp terminal 10 can be considerably improved.

Since the welding connection section 50 is formed by a welding connection section that integrally connects the terminal connection section 20 and the pressure-bonding section 40 by welding, the terminal connection section 20 and the pressure-bonding section 40 can be strongly connected to each other with excellent integrity therebetween.

As described above, since the welding connection section 50 can be integrally connected by welding the terminal connection section 20 and the pressure-bonding section 40 to each other, in a state in which the insulated wire 200 and the female crimp terminal 10 are connected to each other by pressure bonding, if the insulated wire 200 is bent or twisted to apply stress to the female crimp terminal 10, the welding connection section 50 between the pressure-bonding section 40 and the terminal connection section 20 is not separated or displaced from the pressure-bonding section 40 and the terminal connection section 20. Furthermore, since the strength of the connection section can be increased, the connection section is not deformed, and the excellent integrity of the female crimp terminal 10 can be secured.

In particular, when the welding step is performed by fiber laser welding, a laser can be focused on a minimal spot in comparison with other laser welding. High-output laser welding can be achieved, and continuous irradiation can be performed.

Thus, uneven welding such as a gap is not formed in the welding connection section 50, and water can be prevented from entering a gap formed in the welding connection section 50. For this reason, welding having reliable water-blocking performance can be performed. Furthermore, the welding connection section 50 having excellent strength can be secured.

At the facing portions 60 where the pressure-bonding section 40 and the terminal connection section 20 face to each other, the long length direction facing ends 61 (61*a* and 61*b*) facing in the long length direction X are formed, and the welding connection section 50 is formed such that the long length direction facing ends 61*a* and 61*b* of the pressure-bonding section 40 and the terminal connection section 20 are made to abut against each other and the abutted long length direction facing ends 61*a* and 61*b* are welded to each other.

With the configuration, at the facing portions 60 between the pressure-bonding section 40 and the terminal connection section 20, materials configuring the pressure-bonding section 40 and the terminal connection section 20 are not superposed on each other, and welding can be compactly performed without increasing a welded portion in volume.

Thus, even when the female crimp terminal 10 is arranged in a connector housing (not shown), the welding connection section 50 of the female crimp terminal 10 is not increased in volume, particularly in thickness. For this reason, the female crimp terminal 10 can be smoothly inserted into an insertion portion of the connector housing.

Furthermore, as described above, the abutted long length direction facing ends 61*a* and 61*b* are welded to each other to make it easy to uniformly irradiate the laser L to both the abutted long length direction facing ends 61*a* and 61*b*, and both the ends 61*a* and 61*b* can be fused in a balanced manner and tightly welded to each other.

In the method of manufacturing the crimp terminal-bearing wire 1, welding between the terminal connection section 20 and the pressure-bonding section 40 by the laser L is not limited to the method described above. For example, as shown in FIG. 5, the long length direction facing ends 61 may be irradiated with the laser L may be irradiated from one direction of the long length direction X.

Figure 5A:
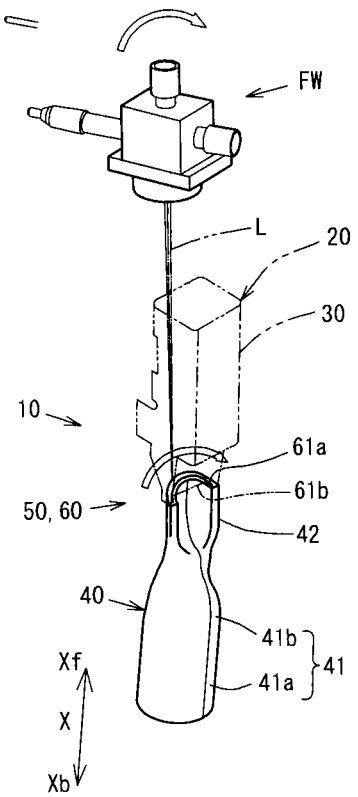
FIGS. 5A and 5B are diagrams for explaining another method of manufacturing a female crimp terminal.
Figure 5B:
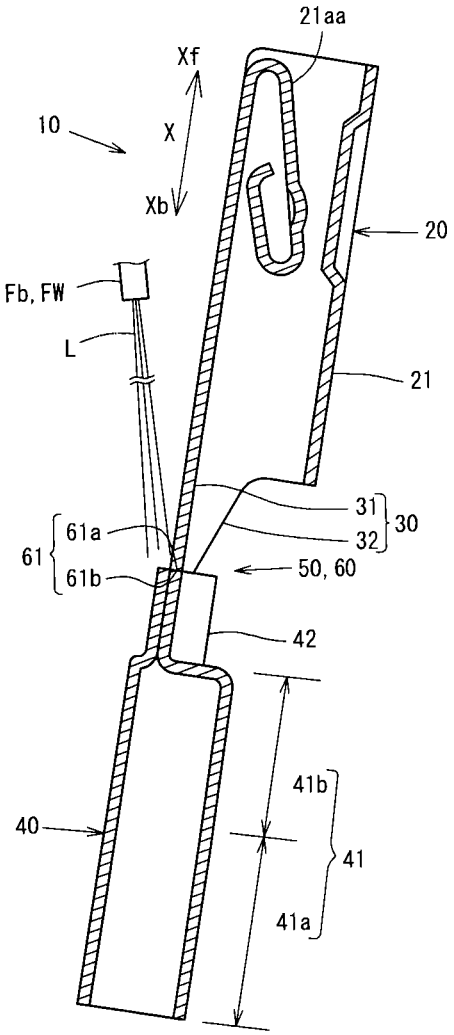

FIGS. 5A and 5B are diagrams for explaining another welding step in which the pressure-bonding section 40 and the terminal connection section 20 are connected to each other by welding, FIG. 5A is an explanatory diagram in which the terminal connection section 20 of the female crimp terminal 10 is indicated by a virtual line, and FIG. 5B is a diagram for explaining the other welding step in a state in which the female crimp terminal 10 is shown as a section.

As shown in FIGS. 5A and 5B, in the welding step, as described above, at the facing portions 60 where the pressure-bonding section 40 and the terminal connection section 20 face each other, the long length direction facing ends 61*a* and 61*b* facing in the long length direction X are made to abut against each other, and the abutted long length direction facing ends 61*a* and 61*b* are welded to each other.

At this time, in the state in which the long length direction facing ends 61*a* and 61*b* are made to abut against each other, the laser irradiating section Fb is arranged on, for example, the pressure-bonding section 40 side in the long length direction X with reference to the long length direction facing ends 61.

In this state, the long length direction facing ends 61 are irradiated with the laser L from the laser irradiating section Fb in a direction approximately equal to the long length direction X.

The irradiation of the laser L is performed while the laser irradiating section Fb is moved along the long length direction facing ends 61, so that the long length direction facing ends 61 (61*a* and 61*b*) can be welded to each other over the whole length.

While the laser irradiating section Fb is moved along the long length direction facing ends 61, the laser L is not brought into out-of-focus on the long length direction facing ends 61, and welding can be appropriately performed in an in-focus state.

This will be described in more detail. The long length direction facing end 61*a* of the pressure-bonding section 40 is formed to have an arc-like end shape having a U-shape (see FIG. 3A and FIG. 5A). For this reason, as shown in FIG. 3B, for example, when the laser irradiating section Fb is arranged above the female crimp terminal 10 and irradiated with the laser L while the laser irradiating section Fb is moved along the long length direction facing ends 61 formed along the width direction Y, an irradiation distance between the laser irradiating section Fb and the long length direction facing ends 61 varies with the movement of the laser irradiating section Fb. As a result, the laser L is brought into out-of-focus.

In contrast to this, according to the welding method shown in FIGS. 5A and 5B, the butt portions where the long length direction facing ends 61*a* and 61*b* are made to abut against each other are irradiated with the laser L from the laser irradiating section Fb along the direction approximately equal to the long length direction X, i.e., the long length direction X of the female crimp terminal 10.

In this manner, although the long length direction facing end 61*a* of the pressure-bonding section 40 has the arc-like end shape having a U-shape, while the laser irradiating section Fb is moved along the long length direction facing end 61*a* of the pressure-bonding section 40 (see an arrow in FIG. 5A), a focal length of the laser L for the butt portions between the long length direction facing ends 61*a* and 61*b* does not vary.

Thus, while the laser irradiating section Fb is moved along the long length direction facing ends 61, the laser L is not brought into out-of-focus on the long length direction facing ends 61, and welding can be appropriately performed in an in-focus state.

While the laser irradiating section Fb is moved along the long length direction facing ends 61, in order to focus the laser L on the long length direction facing ends 61, the laser irradiating section Fb need not be made to approach and separate from the long length direction facing ends 61, and the welding connection section 50 can be smoothly welded with a simple configuration.

The long length direction facing end 61*b* of the terminal connection section 20 need not be formed in a flat shape as described above, like the long length direction facing end 61*a* of the pressure-bonding section 40, may be formed to have an end shape having an approximate U-shape.

Crimp terminal-bearing wires 1Pa, 1Pb, 1Pc, 1Pd, 1Pe, 1Pf, 1Pg, 1Ph, and 1Pi in another embodiment will be described below.

However, of the configurations of the crimp terminal-bearing wires 1Pa, 1Pb, 1Pc, 1Pd, 1Pe, 1Pf, 1Pg, 1Ph, and 1Pi (will be described later), the same configuration as that of the crimp terminal-bearing wire 1 in the first embodiment will not be explained and provided with the same reference symbol.

Second Embodiment

Figure 6A:
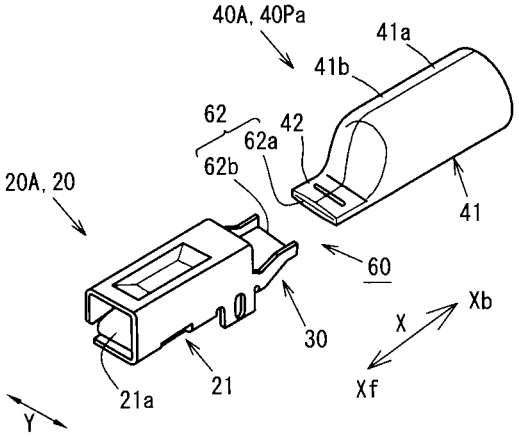
FIGS. 6A and 6B are diagrams for explaining the configurations of a female crimp terminal and a crimp terminal-bearing wire according to a second embodiment.
Figure 6B:
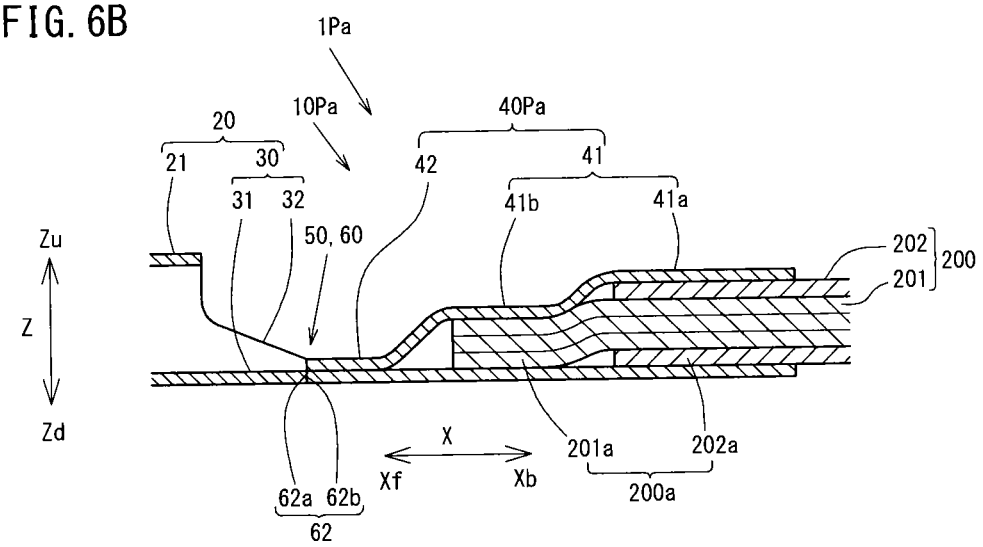

FIGS. 6A and 6B are diagrams for explaining a female crimp terminal 10Pa and a crimp terminal-bearing wire 1Pa according to a second embodiment. This will be described in more detail. FIG. 6A shows a state in which a pressure-bonding section 40Pa and the terminal connection section 20 configured by different members are arranged to be opposed to each other. FIG. 6B is a longitudinal sectional view showing a part of the crimp terminal-bearing wire 1Pa according to the second embodiment.

The crimp terminal-bearing wire 1Pa according to the second embodiment include the female crimp terminal 10Pa configured by the pressure-bonding section 40Pa and the terminal connection section 20.

In the female crimp terminal 10Pa, as shown in FIG. 6A, a long length direction facing end 62 of the pressure-bonding section 40Pa does not have an end shape having a U-shape as described above. As in the terminal connection section 20, the long length direction facing end 62 has an approximately flat shape along the width direction Y.

According to the configuration, in a state in which the long length direction facing ends 62 (62*a* and 62*b*) of the pressure-bonding section 40Pa and the terminal connection section 20 are made to abut against each other, as shown in FIG. 6B, the long length direction facing ends 62 can be made to abut against each other being in linear contact with each other in the width direction Y. More specifically, a contact area corresponding to a plate thickness (wall thickness) of a thinner one of the pressure-bonding section 40Pa and the terminal connection section 20 can be secured over approximately the entire length in the width direction Y.

Thus, when the butt portions where the long length direction facing ends 61*a* and 61*b* are made to abut against each other are irradiated with the laser L, a welding area larger than that obtained when facing ends are made to abut against each other in a point contact state can be secured, and excellent strength in the welding connection section 50 can be obtained.

In addition, when the long length direction facing ends 62 have planar shapes along the width direction Y, unlike in the arc-like long length direction facing ends 61*a* and 61*b* having a U shape, vertical (orthogonal direction Z) positions do not vary along the width direction Y. For this reason, even when the laser irradiation section Fb is arranged above the female crimp terminal 10Pa, the long length direction facing ends 61*a* and 61*b* can be welded to each other in a state the laser L is accurately and smoothly focused on the butt portions where the long length direction facing ends 61*a* and 61*b* are made to abut against each other.

Third Embodiment

Figure 7A:
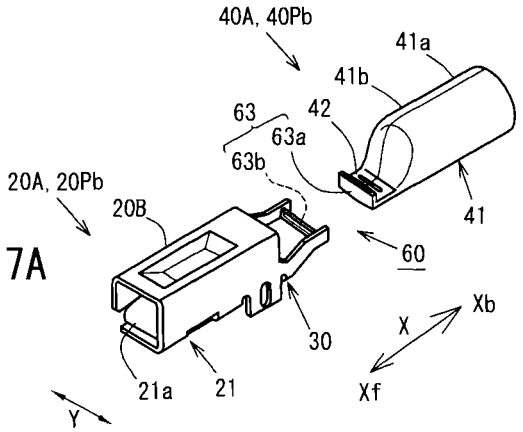
FIGS. 7A and 7B are diagrams for explaining the configurations of a female crimp terminal and a crimp terminal-bearing wire according to a third embodiment.
Figure 7B:
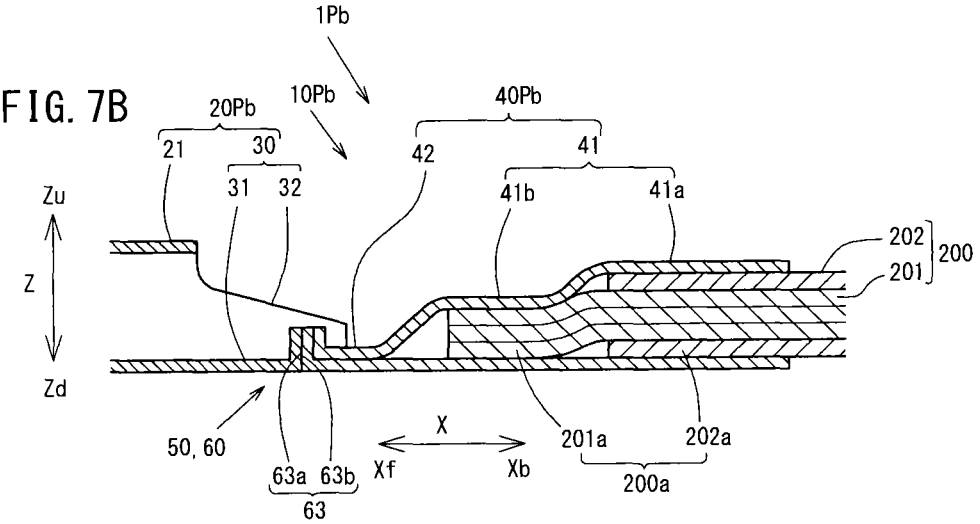

FIGS. 7A and 7B are diagrams for explaining a female crimp terminal 10Pb and a crimp terminal-bearing wire 1Pb according to a third embodiment, FIG. 7A shows a state in which the pressure-bonding section 40Pb and the terminal connection section 20Pb configured by different members are arranged to be opposed to each other. FIG. 7B is a longitudinal sectional view showing a part of the crimp terminal-bearing wire 1Pb according to the third embodiment.

The crimp terminal-bearing wire 1Pa according to the third embodiment, as shown in FIG. 7A, includes the female crimp terminal 10Pb configured by the pressure-bonding section 40Pb and the terminal connection section 20Pb.

In the female crimp terminal 10Pb according to the third embodiment, at the facing portions 60 where the pressure-bonding section 40Pb and the terminal connection section 20Pb face each other, long length direction facing surfaces 63 (63*a* and 63*b*) having a facing area larger than the facing area between the long length direction facing ends 61*a* and 61*b* are formed.

Furthermore, the welding connection section 50 is formed such that the long length direction facing surfaces 63*a* and 63*b* of the pressure-bonding section 40Pb and the terminal connection section 20Pb are made to abut against each other and the abutted long length direction facing surfaces 63*a* and 63*b* are welded to each other.

This will be described in more detail. A tip portion of the sealing portion 42 in the pressure-bonding section 40Pb on the front side Xf in the long length direction X is bent upward at an approximately right angle, and an end face of the bent portion is formed as the long length direction facing surface 63*a* of the pressure-bonding section 40Pb.

On the other hand, a tip portion of the transition section 30 in the terminal connection section 20Pb on the rear side Xb in the long length direction X is bent upward at an approximately right angle, and an end face of the bent portion is formed as the long length direction facing surface 63*b* of the terminal connection section 20Pb.

According to the configuration, the long length direction facing surfaces 63*a* and 63*b* of the pressure-bonding section 40Pb and the terminal connection section 20Pb have thicknesses (widths in a vertical direction) larger than the thicknesses of the boards of the pressure-bonding section 40Pb and the terminal connection section 20Pb. For this reason, when the long length direction facing surfaces 63*a* and 63*b* are made to abut against each other, the surfaces can be in surface contact with each other, and a facing area larger than that obtained when the long length direction facing ends (61*a* and 61*b* or 62*a* and 62*b*) according to the first embodiment and the second embodiment are made to abut against each other can be secured.

Thus, the large facing portions 60 where the long length direction facing surfaces 63*a* and 63*b* are made to abut against each other are welded to each other to make it possible to obtain a large welding area, and can be tightly welded. For this reason, excellent integrity between the pressure-bonding section 40Pb and the terminal connection section 20Pb can be obtained.

Fourth Embodiment

Figure 8A:
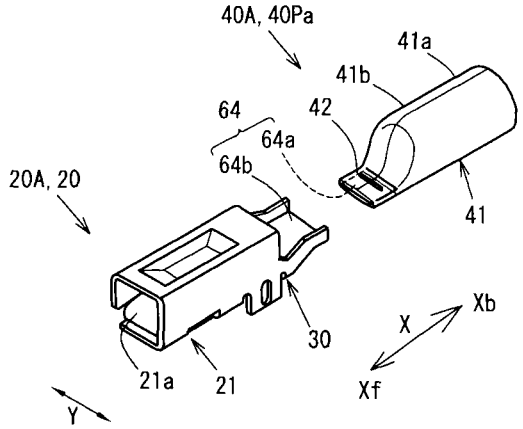
FIGS. 8A and 8B are diagrams for explaining the configurations of a female crimp terminal and a crimp terminal-bearing wire according to a fourth embodiment.
Figure 8B:
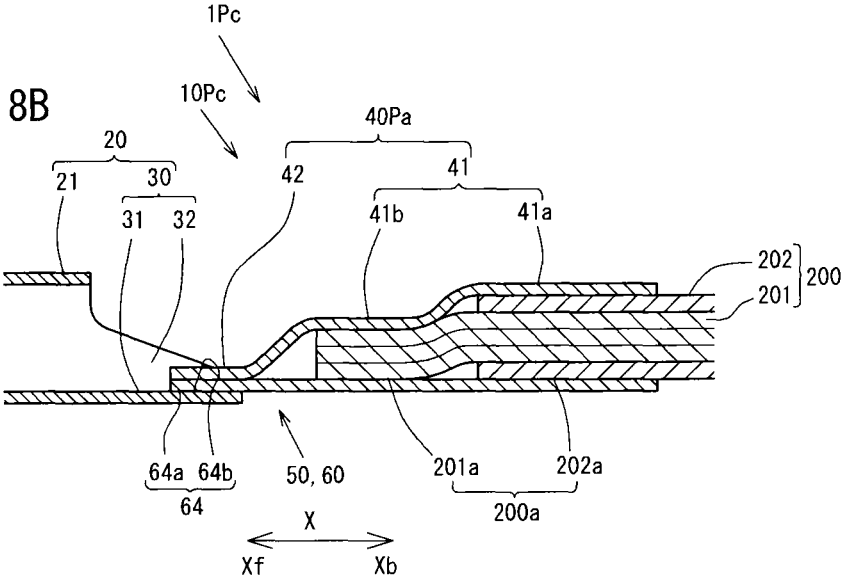

FIGS. 8A and 8B are diagrams for explaining a female crimp terminal 10Pc and a crimp terminal-bearing wire 1Pc according to a fourth embodiment. This will be described in more detail. FIG. 8A shows a state in which the pressure-bonding section 40Pa and the terminal connection section 20 configured by different members are arranged to be opposed to each other. FIG. 8B is a longitudinal section al view showing a part of the crimp terminal-bearing wire 1Pc according to the fourth embodiment.

The crimp terminal-bearing wire 1Pc according to the fourth embodiment, as shown in FIG. 8A, includes the female crimp terminal 10Pc configured by the pressure-bonding section 40Pa and the terminal connection section 20.

In the female crimp terminal 10Pc according to the fourth embodiment, at the facing portions 60 where the pressure-bonding section 40Pa and the terminal connection section 20 face each other, orthogonal direction facing surfaces 64 (64*a* and 64*b*) facing each other in an orthogonal direction Z (vertical direction Z) orthogonal to both the long length direction X and the width direction Y are formed.

In the female crimp terminal 10Pc and the crimp terminal-bearing wire 1Pc according to the fourth embodiment, at the facing portions 60 between the pressure-bonding section 40Pa and the terminal connection section 20, the orthogonal direction facing surfaces 64*a* and 64*b* of the pressure-bonding section 40Pa and the terminal connection section 20 are superposed on each other, and the superposed orthogonal direction facing surfaces 64*a* and 64*b* are welded to each other to form the welding connection section 50.

This will be described in more detail. The sealing portion 42 in the pressure-bonding section 40Pa is formed in an approximately flat plate-like shape including the front end in the long length direction X, and the transition bottom 31 in the terminal connection section 20 is formed in a planar shape including the rear end in the long length direction X.

An approximately flat bottom (lower surface) of the sealing portion 42 in the pressure-bonding section 40Pa is formed as the orthogonal direction facing surface 64*a* of the pressure-bonding section 40Pa, and a flat upper surface of the transition bottom 31 in the terminal connection section 20 is formed as the orthogonal direction facing surface 64*b* of the terminal connection section 20.

The orthogonal direction facing surface 64*a* of the pressure-bonding section 40Pa is placed on the orthogonal direction facing surface 64*b* of the terminal connection section 20 to make it possible to superpose the orthogonal direction facing surfaces 64*a* and 64*b* on each other in a surface contact state.

In this state, superposed portions where the orthogonal direction facing surfaces 64*a* and 64*b* are superposed on each other are welded to each other to form the welding connection section 50.

According to the configuration, the facing portions 60 between the pressure-bonding section 40Pa and the terminal connection section 20 can be superposed on each other in a surface contact state.

Furthermore, in the state in which the facing portions 60 between the pressure-bonding section 40Pa and the terminal connection section 20 are superposed on each other, the sealing portion 42 is latched from both sides in the width direction Y by transition side walls 32 projecting from both the sides of the transition bottom 31.

When the welding is performed in the state, the orthogonal direction facing surfaces 64*a* and 64*b* between the pressure-bonding section 40Pa and the terminal connection section 20 can be stably arranged while being superposed on each other in a surface contact state, and the sealing portion 42 is latched by the transition side walls 32 in the width direction Y. For this reason, the orthogonal direction facing surfaces 64*a* and 64*b* can be accurately welded to each other without being displaced from each other, and the pressure-bonding section 40Pa and the terminal connection section 20 can be tightly connected to each other.

In the welding step to connect the pressure-bonding section 40Pa and the terminal connection section 20 to each other, in addition to the welding step, a welding step in which, at a position corresponding to the sealing portion 42, the terminal connection section configuring member 20A is compressed and integrally welded in a superposing state to form the sealing portion 42 may be performed at a time.

Fifth Embodiment

Figure 9A:
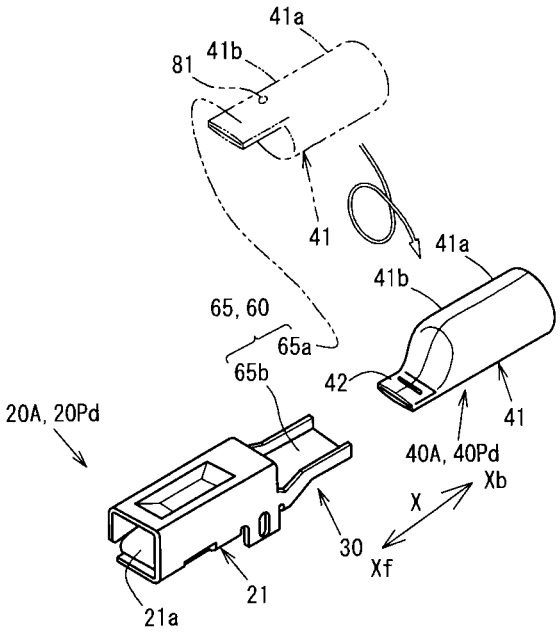
FIGS. 9A and 9B are diagrams for explaining the configurations of a female crimp terminal and a crimp terminal-bearing wire according to a fifth embodiment.
Figure 9B:
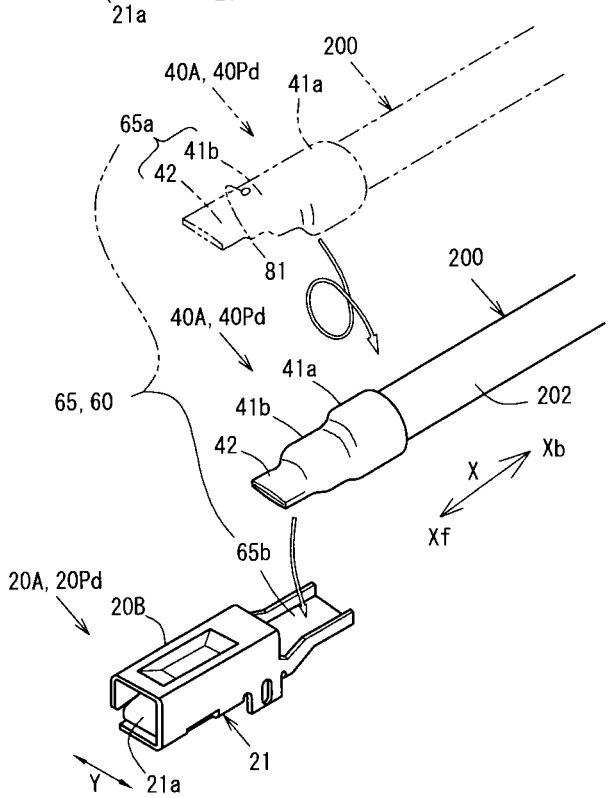

FIGS. 9A and 9B are diagrams for explaining a female crimp terminal 10Pd and a crimp terminal-bearing wire 1Pd according to a fifth embodiment. This will be described in more detail. FIG. 9A shows a state in which the pressure-bonding section 40Pd and the terminal connection section 20Pd configured by different members are arranged to be opposed to each other. FIG. 9B is a diagram for explaining the step of manufacturing the crimp terminal-bearing wire 1Pd according to the fifth embodiment.

Figure 10:
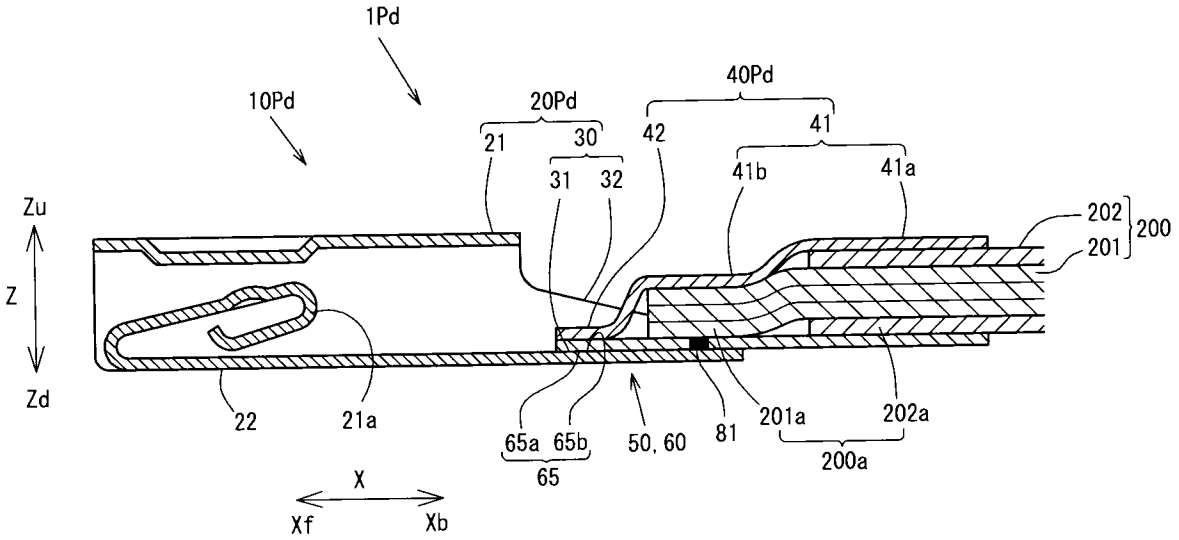
FIG. 10 is a diagram for explaining the configuration of the crimp terminal-bearing wire according to the fifth embodiment.

FIG. 10 is a longitudinal section view showing the crimp terminal-bearing wire 1Pd according to the fifth embodiment.

The crimp terminal-bearing wire 1Pd according to the fifth embodiment, as shown in FIG. 9A, includes the female crimp terminal 10Pd configured by the pressure-bonding section 40Pd and the terminal connection section 20Pd.

The transition section 30 of the terminal connection section 20Pd projects with a length enough to place the sealing portion 42 and the conductor pressure-bonding section 41*b*.

In the female crimp terminal 10Pd according to the fifth embodiment, for example, below the conductor pressure-bonding section 40Pd in the pressure-bonding section 40Pd, a through hole 81 penetrating a pressure-bonding section configuring material in a thickness direction is formed such that the conductor tip 201*a* pressure-bonded by the pressure-bonding section 40Pd can be visually recognized from the outside of the conductor pressure-bonding section 41*b*.

As described above, when the through hole 81 is formed in the conductor pressure-bonding section 41*b*, in a state in which the pressure-bonding section 40Pd is pressure-bonded to the conductor tip 201*a*, the inside of the conductor tip 201*a* can be visually recognized from the outside of the pressure-bonding section 40Pd.

In this manner, for example, a pressure-bonding state caused by the pressure-bonding section 40Pd, typified by the position of the aluminum core wire 201 in the pressure-bonding section 40Pd, such as a state in which the aluminum core wire 201 is eccentrically located on one side in the width direction Y in the pressure-bonding section 40Pd or improperly twisted or bent can be visually confirmed. Furthermore, in pressure-bonding of the pressure-bonding section 40Pd to the wire tip 200*a*, it can be visually confirmed through the through hole 81 whether the conductor tip 201*a* is inserted deeply into the conductor pressure-bonding section 41*b*.

Thus, the crimp terminal-bearing wire 1Pd in an excellent pressure-bonding state can be obtained. Even if a defective product occurs in a post-pressure-bonding state, the defective product can be excluded at a glance to contribute to quality improvement.

In this case, in the crimp terminal-bearing wire 1Pd, the pressure-bonding section 40Pd is connected to the wire tip 200*a* by pressure bonding before the pressure-bonding section 40Pd and the terminal connection section 20Pd are connected to each other by welding.

In this manner, the pressure-bonding section 40Pd in the pressure-bonding state can be a flat shape thinner than that obtained in a pre-pressure-bonding state with the conductor pressure-bonding section 41*b*, in particular.

In this case, a portion that corresponds to the sealing portion 42 and the conductor pressure-bonding section 41*b* in the pressure-bonding section 40Pd in the pressure-bonding state and is a surface on a side having the through hole 81 is set as an orthogonal direction facing surface 65*a* of the pressure-bonding section 40Pd.

More specifically, the sealing portion 42 of the pressure-bonding section 40Pd and the bottom side of the conductor pressure-bonding section 41 *b* are set as the orthogonal direction facing surface 65*a* of the pressure-bonding section 40Pd.

On this other hand, on an upper surface of the transition bottom of the terminal connection section 20Pd, a portion on which the sealing portion 42 and the conductor pressure-bonding section 41*b* can be placed is set as an orthogonal direction facing surface 65*b* of the terminal connection section 20Pd.

As shown in FIG. 9B, the orthogonal direction facing surface 65*a* in which the through hole 81 in the pressure-bonding section 40Pd is formed is caused to face the orthogonal direction facing surface 65*b* of the terminal connection section 20Pd and superposed on the orthogonal direction facing surface 65*b*, and the superposed portions are welded to each other to connect the pressure-bonding section 40Pd and the terminal connection section 20Pd to each other.

According to the configuration, the orthogonal direction facing surface 65*a* having the through hole 81 in the pressure-bonding section 40Pd and the orthogonal direction facing surface 65*b* in the terminal connection section 20Pd can be welded to each other in the state in which the orthogonal direction facing surface 65*a* and the orthogonal direction facing surface 65*b* are superposed on each other.

Thus, when welding is performed in the above aspect, as shown in FIG. 10, the welding can be performed to close the through hole 81. For this reason, in the state in which the pressure-bonding section 40Pd and the terminal connection section 20Pd are connected to each other, moisture does not enter the inside of the pressure-bonding section 40Pd through the through hole 81, and excellent water-blocking performance can be secured.

Furthermore, two different steps, i.e., the step of connecting the facing portions 60 between the pressure-bonding section 40Pd and the terminal connection section 20Pd to each other by welding and the step of closing the through hole 81 can be performed at a time.

In this manner, the productivity of the female crimp terminal 10Pd excellent in water-blocking performance can be improved.

The through hole 81 is not limited to the form of a perfect circle in a front view, and can be formed in various shapes such as an ellipse, a long hole, and a polygon. In addition, the size of the through hole, the number of through holes, and a position where the through hole is formed are not limited to a specific size, a specific number, and a specific position, respectively.

Sixth Embodiment

Figure 11A:
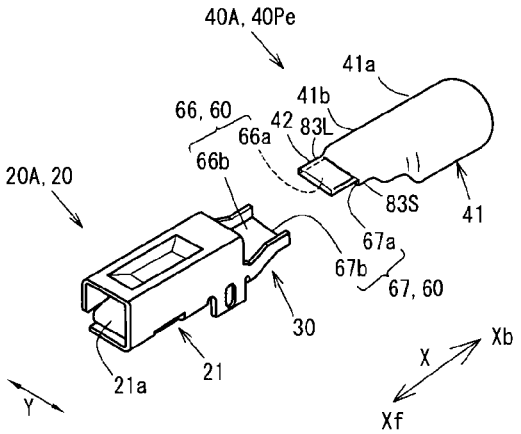
FIGS. 11A and 11B are diagrams for explaining the configurations of a female crimp terminal and a crimp terminal-bearing wire according to a sixth embodiment.
Figure 11B:
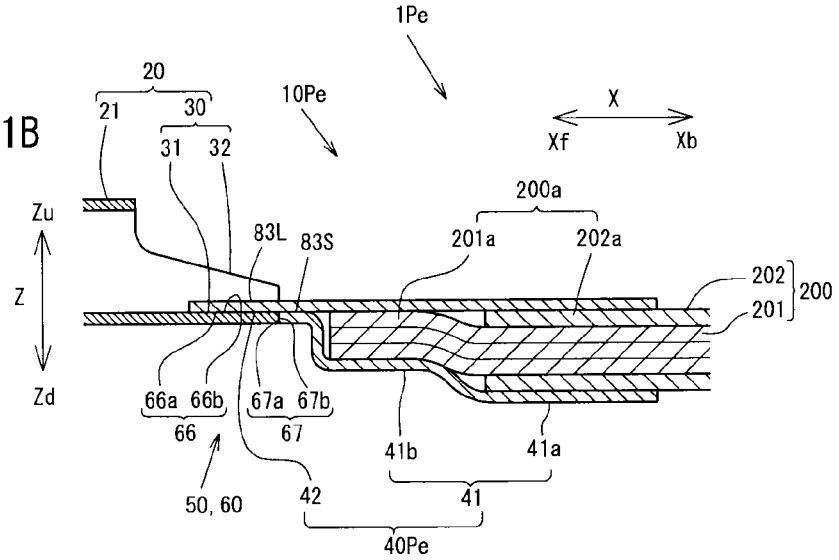

FIGS. 11A and 11B are diagrams for explaining a female crimp terminal 10Pe and a crimp terminal-bearing wire 1Pe according to a sixth embodiment. This will be described in more detail. FIG. 11A shows a state in which a pressure-bonding section 40Pe and the terminal connection section 20 configured by different members are arranged to be opposed to each other. FIG. 11B is a longitudinal sectional view showing a part of the crimp terminal-bearing wire 1Pe according to the sixth embodiment.

The crimp terminal-bearing wire 1Pe according to the sixth embodiment, as shown in FIG. 11A, includes the female crimp terminal 10Pe configured by the pressure-bonding section 40Pe and the terminal connection section 20.

With respect to the female crimp terminal 10Pe according to the sixth embodiment, as shown in FIGS. 11A and 11B, in the female crimp terminal 10Pe and the crimp terminal-bearing wire 1Pe according to the sixth embodiment, at the sealing portion 42 on the pressure-bonding section 40Pe, of two pressure-bonding section configuring materials superposed on each other, one material (83S) is formed to project on the front side in the long length direction X with a length smaller than that of the other material (83L).

In this case, one material in the sealing portion 42 is set as a short projecting piece 83S, and the other material is set as a long projecting piece 83L. In this manner, the sealing portion 42 is formed to have a different level on the front side in a thickness direction (vertical direction Z).

Furthermore, an end face of both the surfaces of the long projecting piece 83L on a side on which the short projecting piece 83S is arranged is set as an orthogonal direction facing surface 66*a* of the pressure-bonding section 40Pe, and an end of the short projecting piece 83S on the front side in the long length direction X is set as a long length direction facing end 67*a* of the pressure-bonding section 40Pe.

On the other hand, on the upper surface of the transition bottom of the terminal connection section 20, a portion of the pressure-bonding section 40Pe on which the long length direction facing ends 61 can be placed is set as an orthogonal direction facing surface 66*b* of the terminal connection section 20.

Furthermore, a rear end of the transition bottom of the terminal connection section 20 in the long length direction X is set as a long length direction facing end 67*b* of the terminal connection section 20.

As shown in FIG. 11B, the pressure-bonding section 40Pe and the terminal connection section 20 are arranged such that the long length direction facing surfaces 66 (66*a* and 66*b*) between the pressure-bonding section 40Pe and the terminal connection section 20 face to each other and the long length direction facing ends 67 (67*a* and 67*b*) face each other.

In this manner, the orthogonal direction facing surfaces 66*a* and 66*b* between the pressure-bonding section 40Pe and the terminal connection section 20 are superposed on each other in a surface contact state, and the long length direction facing ends 67*a* and 67*b* between the pressure-bonding section 40Pe and the terminal connection section 20 are made to abut against each other in a line contact state.

Thus, the superposed portions between the orthogonal direction facing surfaces 66*a* and 66*b* between the pressure-bonding section 40Pe and the terminal connection section 20 are welded to each other, and the butt portions of the long length direction facing ends 67*a* and 67*b* between the pressure-bonding section 40Pe and the terminal connection section 20 are welded to each other to make it possible to connect the pressure-bonding section 40Pe and the terminal connection section 20 to each other tightly more than those obtained when only one pair of portions are welded to each other.

Seventh Embodiment

Figure 12A:
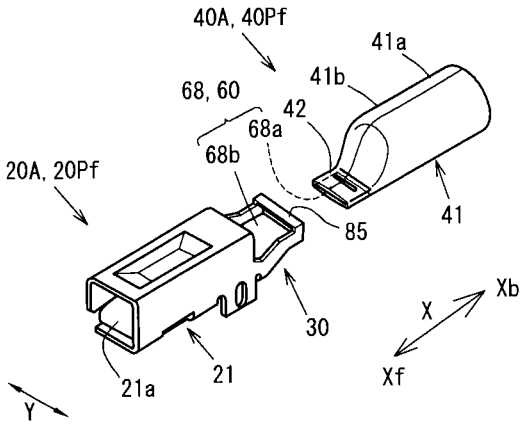
FIGS. 12A and 12B are diagrams for explaining the configurations of a female crimp terminal and a crimp terminal-bearing wire according to a seventh embodiment.
Figure 12B:
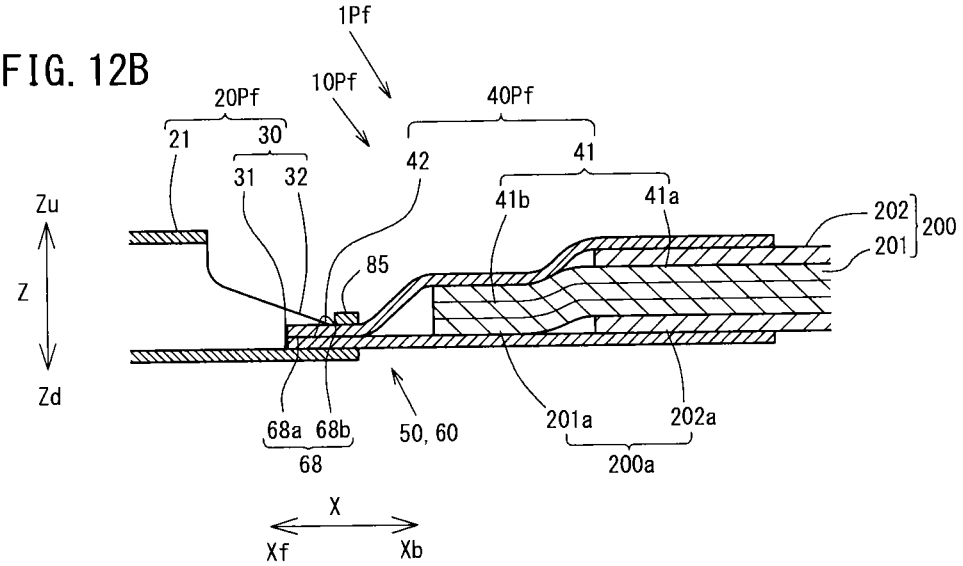

FIGS. 12A and 12B are diagrams for explaining a female crimp terminal 10Pf and a crimp terminal-bearing wire 1Pf according to a seventh embodiment. This will be described in more detail. FIG. 12A shows a state in which a pressure-bonding section 40Pf and a terminal connection section 20Pf configured by different members are arranged to be opposed to each other. FIG. 12B is a longitudinal sectional view showing a part of the crimp terminal-bearing wire 1Pf according to the seventh embodiment.

The crimp terminal-bearing wire 1Pf according to the seventh embodiment, as shown in FIG. 12A, includes the female crimp terminal 10Pf configured by the pressure-bonding section 40Pf and the terminal connection section 20Pf.

In the female crimp terminal 10Pf according to the seventh embodiment, at the facing portions 60 where the pressure-bonding section 40Pf and the terminal connection section 20Pf face each other, a pressure latching section 85 that latches the facing portions 60 in a facing state is formed.

The pressure latching section 85 is arranged in the width direction Y such that the pressure latching section 85 horizontally bridges the transition side walls 32 at the rear-side end Xb of the terminal connection section 20Pf in the long length direction X. The rear-side end of the terminal connection section 20Pf in the long length direction X is configured in an annular shape in which the sealing portion 42 of the pressure-bonding section 40Pf is fitted by the transition section 30 and the pressure latching section 85.

In this case, the bottom of the sealing portion 42 of the pressure-bonding section 40Pf is set as an orthogonal direction facing surface 68*a* of the pressure-bonding section 40Pf, and the upper surface of the transition bottom 31 of the terminal connection section 20Pf is set as an orthogonal direction facing surface 68*b* of the terminal connection section 20Pf.

In the state in which the orthogonal direction facing surfaces 68 (68*a* and 68*b*) of the pressure-bonding section 40Pf and the terminal connection section 20Pf are superposed on each other, the sealing portion 42 of the pressure-bonding section 40Pf is latched by the pressure latching section 85.

In this manner, the superposed portions of the orthogonal direction facing surfaces 68*a* and 68*b* between the pressure-bonding section 40Pf and the terminal connection section 20Pf are welded to each other in the state in which the sealing portion 42 of the pressure-bonding section 40Pf is latched by the pressure latching section 85 to make it possible to integrally connect the pressure-bonding section 40Pf and the terminal connection section 20Pf to each other.

As described above, since the facing portions 60 between the pressure-bonding section 40Pf and the terminal connection section 20Pf are welded to each other while being latched, when the facing portions 60 are welded to each other, the pressure-bonding section 40Pf and the terminal connection section 20Pf can be smoothly welded to each other without displacing the pressure-bonding section 40Pf and the terminal connection section 20Pf from each other to have a correct shape in which the pressure-bonding section 40Pf and the terminal connection section 20Pf are arranged in series with each other.

Furthermore, since the sealing portion 42 can be latched by the pressure latching section 85 even after the pressure-bonding section 40Pf and the terminal connection section 20Pf are connected to each other, the orthogonal direction facing surfaces 68*a* and 68*b* can be kept in a tight connection state.

Eighth Embodiment

Figure 13A:
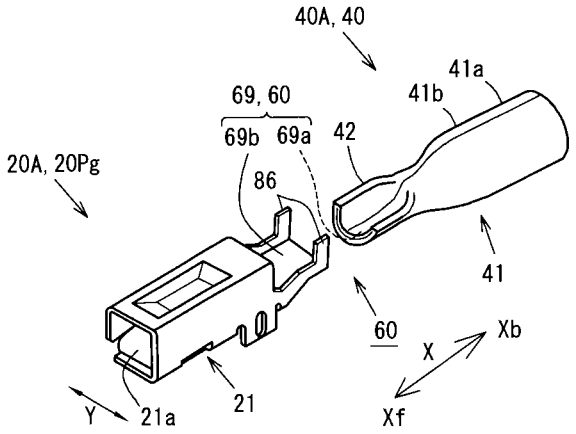
FIGS. 13A and 13B are diagrams for explaining the configurations of a female crimp terminal and a crimp terminal-bearing wire according to an eighth embodiment.
Figure 13B:
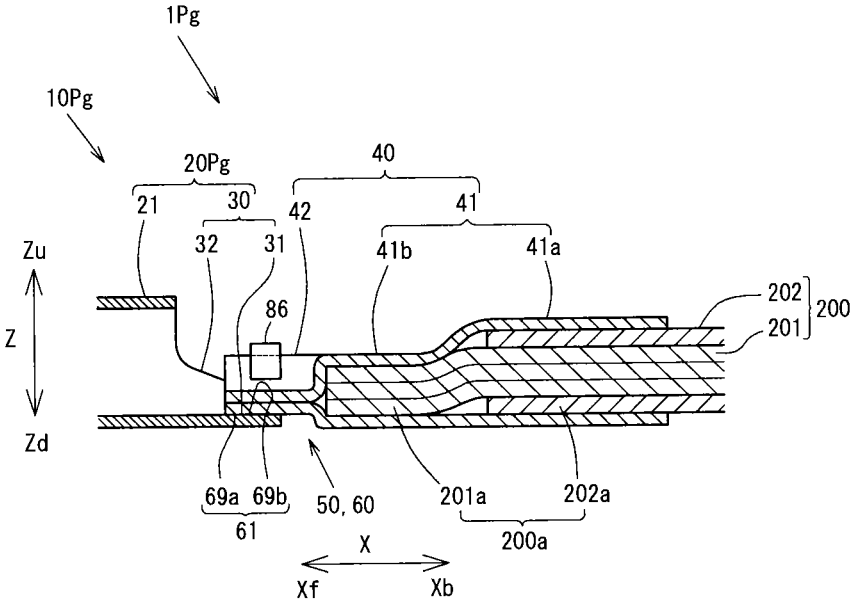

FIGS. 13A and 13B are diagrams for explaining a female crimp terminal 10Pg and a crimp terminal-bearing wire 1Pg according to an eighth embodiment. This will be described in more detail. FIG. 13A shows a state in which the pressure-bonding section 40 and a terminal connection section 20Pg configured by different members are arranged to be opposed to each other. FIG. 13B is a longitudinal sectional view showing a part of the crimp terminal-bearing wire 1Pg according to the eighth embodiment.

The crimp terminal-bearing wire 1Pg according to the eighth embodiment, as shown in FIG. 13A, includes the female crimp terminal 10Pg configured by the pressure-bonding section 40 and the terminal connection section 20Pg.

In the female crimp terminal 10Pg according to the eighth embodiment, at the facing portions 60 where the pressure-bonding section 40 and the terminal connection section 20Pg face each other, latching projecting pieces 86 that latch the facing portions 60 in a facing state are formed.

The latching projecting pieces 86 are formed to project from the transition side walls 32 at the rear-side end Xb of the terminal connection section 20Pg in the long length direction X.

The sealing portion 42 of the pressure-bonding section 40 is formed to have a U-shaped orthogonal section in a sectional view. The bottom of the sealing portion 42 of the pressure-bonding section 40 is set as an orthogonal direction facing surface 69*a* of the pressure-bonding section 40. On the other hand, the upper surface of the transition bottom 31 of the terminal connection section 20Pg is set as an orthogonal direction facing surface 69*b* of the terminal connection section 20Pg.

As shown in FIG. 13B, in a state in which the orthogonal direction facing surfaces 69 (69*a* and 69*b*) of the pressure-bonding section 40 and the terminal connection section 20Pg are superposed on each other, the latching projecting pieces 86 are bent to the sealing portion 42 side of the pressure-bonding section 40 to make it possible to cause the sealing portion 42 of the pressure-bonding section 40 to be latched at each end of a U-shape in cross section in the width direction Y.

In this manner, in the state in which the sealing portion 42 of the pressure-bonding section 40 is latched by the latching projecting pieces 86, the superposed portions of the orthogonal direction facing surfaces 69*a* and 69*b* between the pressure-bonding section 40 and the terminal connection section 20Pg are welded to each other to make it possible to integrally connect the pressure-bonding section 40 and the terminal connection section 20Pg.

As described above, since the facing portions 60 between the pressure-bonding section 40 and the terminal connection section 20Pg can be welded to each other while being latched, when the facing portions 60 are welded to each other, the pressure-bonding section 40 and the terminal connection section 20Pg can be smoothly welded to each other in a correct shape in which the pressure-bonding section 40 and the terminal connection section 20Pg are arranged in series with each other without being displaced from each other.

Furthermore, since the sealing portion 42 can be latched by the latching projecting pieces 86 even after the pressure-bonding section 40 and the terminal connection section 20Pg are connected to each other, the orthogonal direction facing surfaces 69*a* and 69*b* can be kept in a tight connection state.

Ninth Embodiment

Figure 14A:
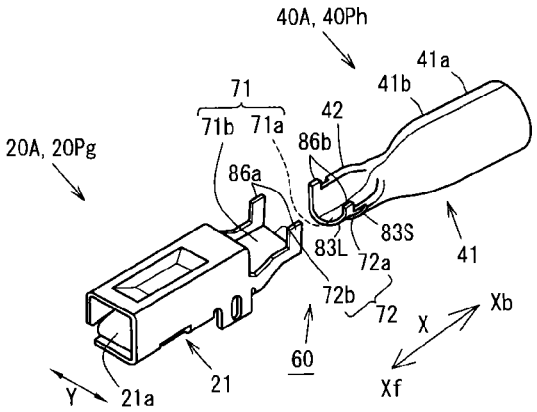
FIGS. 14A to 14C are diagrams for explaining the configurations of a female crimp terminal and a crimp terminal-bearing wire according to a ninth embodiment.
Figure 14B:
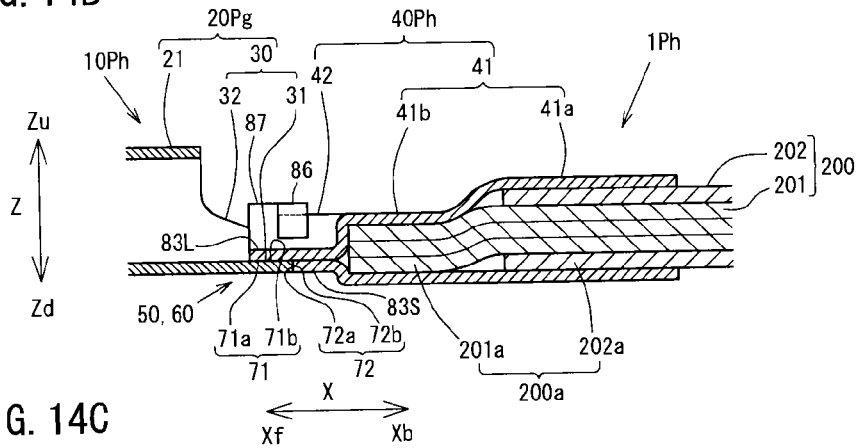
Figure 14C:
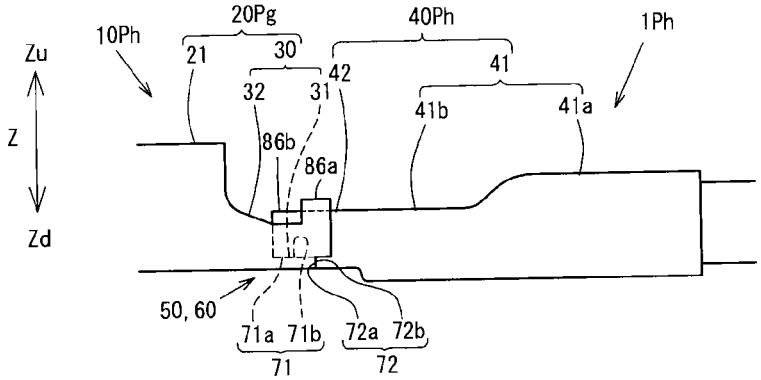

FIGS. 14A to 14C are diagrams for explaining a female crimp terminal 10Ph and a crimp terminal-bearing wire 1Ph according to a ninth embodiment. This will be described in more detail. FIG. 14A shows a state in which a pressure-bonding section 40Ph and a terminal connection section 20Pg configured by different members are arranged to be opposed to each other. FIG. 14B is a longitudinal sectional view showing a part of the crimp terminal-bearing wire 1Ph according to the ninth embodiment. FIG. 14C is a right-side view showing a part of the crimp terminal-bearing wire 1Ph according to the ninth embodiment.

The crimp terminal-bearing wire 1Ph according to the ninth embodiment, as shown in FIG. 14A, includes the female crimp terminal 10Ph configured by the pressure-bonding section 40Ph and the terminal connection section 20Pg.

The female crimp terminal 10Ph according to the ninth embodiment can be configured by a combination between the female crimp terminal 10Pe according to the sixth embodiment and the female crimp terminal 10Pg according to the eighth embodiment.

This will be described in more detail. In the female crimp terminal 10Ph and the crimp terminal-bearing wire 1Ph according to the ninth embodiment, the sealing portion 42 in the pressure-bonding section 40Ph is formed to have a U-shape in an orthogonal sectional view. However, as in the sixth embodiment, in the sealing portion 42 configured by superposing the two materials in a tight contact state, one material (83S) is formed to project on the front side in the long length direction X with a length smaller than that of the other material (83L) (FIG. 14B).

Furthermore, an end face of a surface of both the surfaces of the long projecting piece 83L on a side on which the short projecting piece 83S is arranged is set as an orthogonal direction facing surface 71*a* of the pressure-bonding section 40Ph, and an end of the short projecting piece 83S on the front side in the long length direction X is set as a long length direction facing end 72*a* of the pressure-bonding section 40Ph.

On the other hand, on the upper surface of the transition bottom of the terminal connection section 20Pg, a portion on which the long length direction facing end 61 of the pressure-bonding section 40Ph can be placed is set as a long length direction facing surface 71*b* of the terminal connection section 20Pg.

Furthermore, a rear end of the transition bottom of the terminal connection section 20Pg in the long length direction X is set as the long length direction facing end 72*b* of the terminal connection section 20Pg.

In the female crimp terminal 10Ph and the crimp terminal-bearing wire 1Ph according to the ninth embodiment, as in the eighth embodiment, at the facing portion 60 of the terminal connection section 20Pg facing the pressure-bonding section 40Ph, first latching projecting pieces 86*a* that latch the facing portions 60 in a facing state are formed.

Furthermore, at the facing portion 60 of the pressure-bonding section 40Ph facing the terminal connection section 20Pg, second latching projecting pieces 86*b* that can be engaged with the first latching projecting pieces 86*a* in the long length direction X are formed.

The pressure-bonding section 40Ph and the terminal connection section 20Pg are arranged such that the orthogonal direction facing surfaces 71 (71*a* and 71*b*) between the pressure-bonding section 40Ph and the terminal connection section 20Pg face each other and the long length direction facing ends 72 (72*a* and 72*b*) face each other.

In this state, as shown in FIGS. 14B and 14C, the latching projecting pieces 86 are bent on the sealing portion 42 side of the pressure-bonding section 40Ph to make it possible to cause the sealing portion 42 of the pressure-bonding section 40Ph to be latched at each end of a U-shape in cross section in the width direction Y.

Furthermore, in this state, the first latching projecting pieces 86*a* and the second latching projecting pieces 86*b* are engaged with each other in the long length direction X.

Thus, in the state in which the sealing portion 42 of the pressure-bonding section 40Ph is latched by the latching projecting pieces 86, the superposed portions of the orthogonal direction facing surfaces 71*a* and 71*b* between the pressure-bonding section 40Ph and the terminal connection section 20Pg can be welded to each other, and butt portions of the long length direction facing ends 72*a* and 72*b* between the pressure-bonding section 40Ph and the terminal connection section 20Pg can be welded to each other.

Thus, the pressure-bonding section 40Ph and the terminal connection section 20Pg can be connected to each other tightly more than those obtained when only one pair of portions are welded to each other.

Furthermore, since the facing portions 60 between the pressure-bonding section 40Ph and the terminal connection section 20Pg can be welded to each other while being latched, when the facing portions 60 are welded to each other, the pressure-bonding section 40Ph and the terminal connection section 20Pg can be smoothly welded to each other without displacing the pressure-bonding section 40Ph and the terminal connection section 20Pg from each other to have a correct shape in which the pressure-bonding section 40Ph and the terminal connection section 20Pg are arranged in series with each other.

In the configuration of the female crimp terminal 10Ph according to the sixth embodiment, as described above, not only the configuration including the latching projecting pieces 86*a* and 86*b*, but also a configuration including the pressure latching section 85 may be used.

Tenth Embodiment

Figure 15:
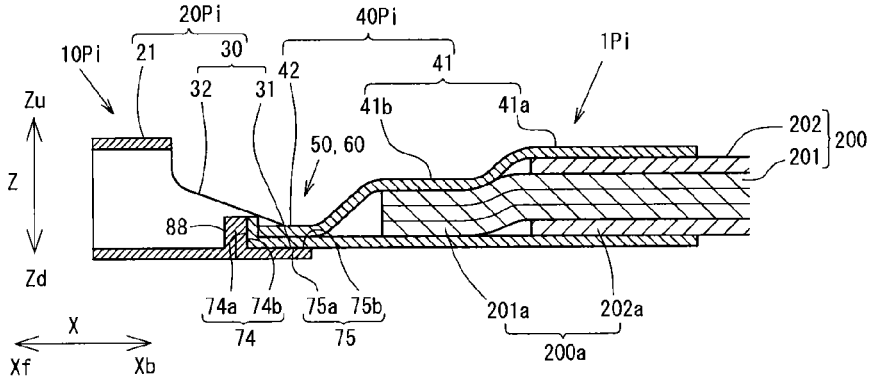
FIG. 15 is a diagram for explaining the configurations of a female crimp terminal and a crimp terminal-bearing wire according to a tenth embodiment.

FIG. 15 is a diagram for explaining a female crimp terminal 10Pi and a crimp terminal-bearing wire 1Pi according to a tenth embodiment, and FIG. 15 is a longitudinal sectional view showing a part of the crimp terminal-bearing wire 1Pi according to the tenth embodiment.

The crimp terminal-bearing wire 1Pi according to the tenth embodiment, as shown in FIG. 15, includes the female crimp terminal 10Pi configured by a pressure-bonding section 40Pi and a terminal connection section 20Pi.

In the female crimp terminal 10Pi according to the tenth embodiment, an upright projecting piece 88 is formed that is obtained such that a base portion of the transition bottom 31 in the terminal connection section 20Pi projects upward Zu.

In this case, an end face of the upright projecting piece 88 on a rear side Xb is set as a long length direction facing surface 74*b* of the terminal connection section 20, and an upper surface of the transition bottom 31 of the terminal connection section 20 is set as an orthogonal direction facing surface 75*b* of the terminal connection section 20.

On the other hand, an end portion of the sealing portion 42 of the pressure-bonding section 40 on a front side Xf is formed as a long length direction facing surface 74*a* of the pressure-bonding section 40, and an approximately flat bottom (lower surface) of the sealing portion 42 of the pressure-bonding section 40 is formed as an orthogonal direction facing surface 75*a* of the pressure-bonding section 40Pa.

As shown in FIG. 15, the pressure-bonding section 40Pi and the terminal connection section 20Pi are arranged such that the long length direction facing surfaces 74 (74*a* and 74*b*) between the pressure-bonding section 40Pi and the terminal connection section 20Pi face each other and the orthogonal direction facing surfaces 75 (75*a* and 75*b*) face each other.

In this manner, the orthogonal direction facing surfaces 75 (75*a* and 75*b*) between the pressure-bonding section 40Pi and the terminal connection section 20Pi are superposed on each other in a surface contact state, and the long length direction facing surfaces 74 (74*a* and 74*b*) between the pressure-bonding section 40Pi and the terminal connection section 20Pi are made to abut against each other in a surface contact state.

Thus, the superposed portions in a surface contact state of the orthogonal direction facing surfaces 75*a* and 75*b* between the pressure-bonding section 40Pi and the terminal connection section 20Pi are welded to each other, the butt portions in a surface contact state of the long length direction facing surfaces 74*a* and 74*b* between the pressure-bonding section 40Pi and the terminal connection section 20Pi are welded to each other to make it possible to connect the pressure-bonding section 40Pi and the terminal connection section 20Pi to each other tightly more than those obtained when only one pair of portions are welded to each other.

In the correspondences between the configurations of the invention and the embodiments, the pressure-bonded connection structural body according to the invention corresponds to the crimp terminal-bearing wires 1, 1Pa, 1Pb, 1Pc, 1Pd, 1Pe, 1Pf, 1Pg, 1Ph, and 1Pi according to the embodiment, and, similarly, the crimp terminal corresponds to the female crimp terminals 10, 10Pa, 10Pb, 10Pc, 10Pd, 10Pe, 10Pf, 10Pg, 10Ph, and 10Pi, the latching section corresponds to the pressure latching section 85, the latching projecting piece 86, the first latching projecting piece 86*a*, and the second latching projecting piece 86*b*, the conductor corresponds to the aluminum core wire 201, the other connection terminal corresponds to the male crimp terminal, and the plate material corresponds to the terminal material 100 (material).

However the invention is not limited to only the above configurations of the embodiments, the invention can be applied on the basis of the technical idea described in the claims and can obtain a large number of embodiments.

For example, in a crimp terminal-bearing wire, the facing portions 60 between a terminal connection section and a pressure-bonding section are not limited to the formations in the embodiments described above, and can be configured by other formations.

The methods of manufacturing the crimp terminal-bearing wires 1Pa, 1Pb, 1Pc, 1Pd, 1Pe, 1Pf, 1Pg, 1Ph, and 1Pi are not limited to the manufacturing methods described above.

Figure 16A:
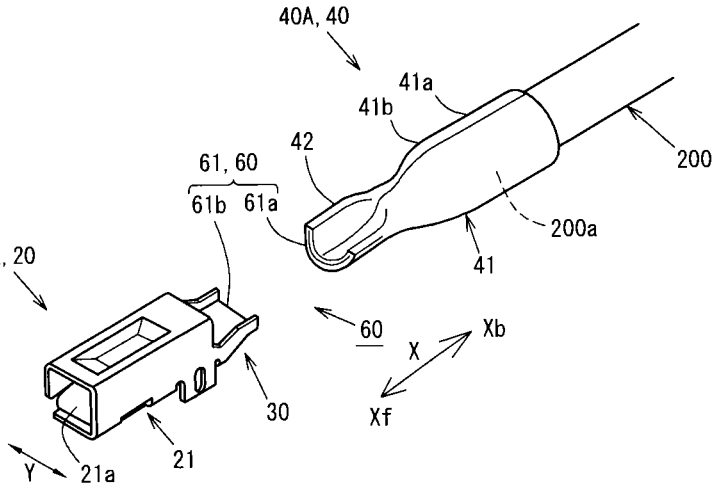
FIGS. 16A and 16B are diagrams for explaining another method of manufacturing a crimp terminal-bearing wire according to another embodiment.
Figure 16B:
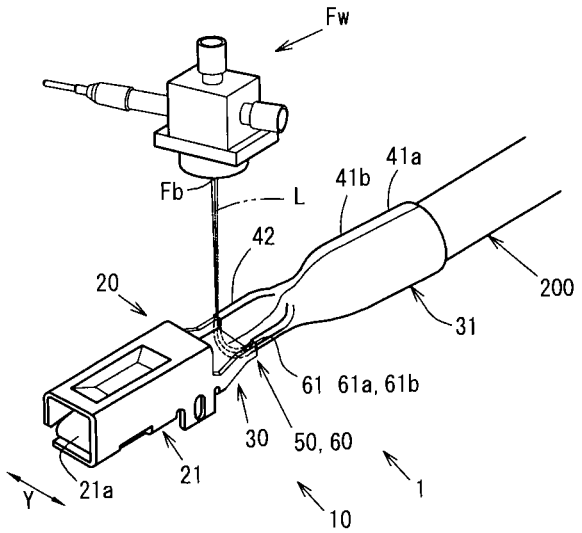

For example, the female crimp terminal 10 and the crimp terminal-bearing wire 1 according to the first embodiment can be manufactured as shown in FIGS. 16A and 16B.

FIGS. 16A and 16B are diagrams for explaining another method of manufacturing the crimp terminal-bearing wire 1 according to another embodiment. This will be described in more detail. FIG. 16A is a diagram for explaining a state in which, before the pressure-bonding section 40 and the terminal connection section 20 are connected to each other, the pressure-bonding section 40 connected to a wire tip and the terminal connection section 20 are arranged to opposed to each other.

FIG. 16B shows a manner of connecting the pressure-bonding section 40 and the terminal connection section 20 configured by different members by welding.

This will be described in more detail. In the female crimp terminal 10 and the crimp terminal-bearing wire 1 according to the first embodiment, the pressure-bonding section 40 need not be pressure-bonded to the wire tip after the pressure-bonding section 40 and the terminal connection section 20 are connected to each other, as in the female crimp terminal 10Pd and the crimp terminal-bearing wire 1Pd according to the fifth embodiment, as shown in FIG. 16A, after the pressure-bonding section 40 is pressure-bonded to the wire tip 200*a*, as shown in FIG. 16B, the pressure-bonding section 40 and the terminal connection section 20 may be connected to each other.

Also in the other embodiments except for the first embodiment and the fifth embodiment, as in the female crimp terminal 10 and the crimp terminal-bearing wire 1 according to the first embodiment, the order of the step of connecting the pressure-bonding section 40 and the terminal connection section 20 and the step of pressure-bonding the pressure-bonding section 40 and the wire tip 200*a* is not limited to a specific order.

The pressure-bonding section configuring member 40A need not always be configured by the manufacturing method described above. For example, the pressure-bonding section configuring member 40A may be formed such that a portion corresponding to the sealing portion 42 is welded by the laser L along a welding position in the width direction Y and sealed while being flattened with a mold.

Figure 17A:
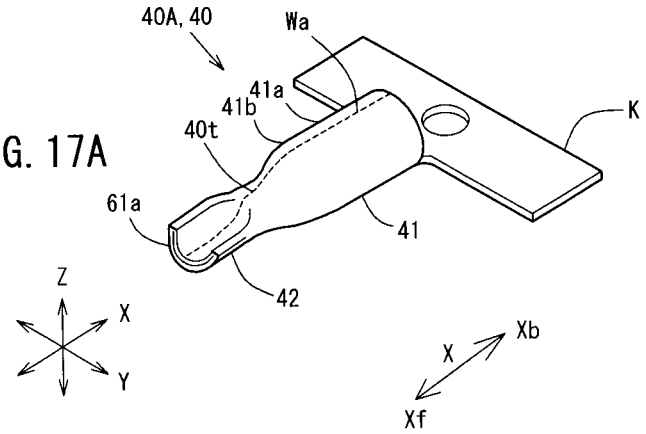
FIGS. 17A and 17B are diagrams for explaining another welding method in the pressure-bonding section.
Figure 17B:
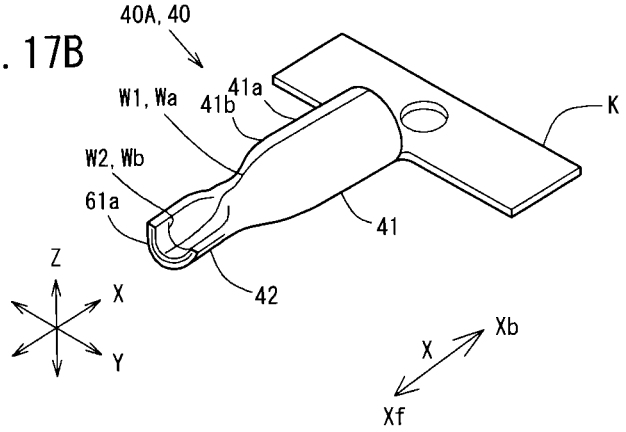

Furthermore, the pressure-bonding section configuring member 40A, as shown in FIGS. 17A and 17B for explaining another welding method in the pressure-bonding section configuring member 40A, may be formed such that, after the shape of the pressure-bonding section configuring member 40A is formed, a welding position Wa moving in an orthogonal direction Z (thickness direction) is welded.

This will be described in more detail. As shown in FIG. 17A, a pressure-bonding section configuring material (copper alloy strip) punched in a terminal shape is rounded to abut ends 40*t* against each other, a front-end portion in the long length direction X is flattened out, and the resultant structure is formed in advance in the form of the pressure-bonding section configuring member 40A including the sealing portion 42.

The ends 40*t* superposed on each other by the rounding are welded to each other by the laser L along the welding position Wa in the long length direction X to form a welding portion W1, and welding is performed along a welding position Wb in the width direction Y in the sealing portion 42 to form and seal a welding portion W2 so as to complete the pressure-bonding section configuring member 40A.

The pressure-bonding section configuring member 40A, as shown in FIGS. 17A and 17B, the ends 40*t* may be superposed on each other and welded to each other on the upper-surface side of the pressure-bonding section configuring member 40A. However, the welding of this manner need not always be used, and, although not shown, the ends 40*t* may be superposed on each other and welded to each other on the bottom side of the pressure-bonding section configuring member 40A.

Rounding the pressure-bonding section configuring material (copper alloy strip) to superpose the ends 40*t* on each other is not limited to superposing the ends 40*t* in the circumferential direction to abut the ends 40*t* against each other and also includes superposing the ends 40*t* on each other in a radial direction of the pressure-bonding section configuring material cylindrically rounded.

As described above, in various steps for manufacturing the crimp terminal-bearing wire 1, the laser welding is performed.

For example, when the pressure-bonding section configuring member 40A is manufactured, the ends 40*t* abutted against each other by rounding the pressure-bonding section configuring material (copper alloy strip) are welded to each other by a laser along the welding position Wa in the long length direction X, or welded to each other by a laser along the welding position Wb in the width direction Y in the sealing portion 42. Alternatively, as described above, also when the terminal connection sections 20, 20Pb, 20Pd, 20Pf, 20Pg, and 20Pg and the pressure-bonding sections 40, 40Pa, 40Pb, 40Pd, 40Pe, 40Pf, 40Ph, 40Pi, and 40' are integrally connected to each other, laser welding is performed.

In this manner, when the laser welding is performed, a connection state having less deformation in a terminal material can be achieved, and non-contact welding can be performed. For this reason, strength when conductor portions are pressure-bonded by the pressure-bonding section to each other can be secured.

This will be described in more detail. Contact welding such as ultrasonic welding or resistance welding requires mechanical pressure welding strong enough to form a dent, so that stress is concentrated to decrease material strength, and the pressure-bonding section may be damaged when the conductor portion is pressure-bonded. However, in welding using a high-power density beam that is non-contact welding, a decrease in material strength does not occur unlike in the mechanical pressure welding described above, and the pressure-bonding section is not damaged when the conductor portion is pressure-bonded. Therefore, water-blocking performance can be secured, and a stable pressure-bonding state can be maintained.

For example, when the welding is performed as contact welding by brazing, the cost increases, and ultrasonic welding requires an anvil and a horn. Resistance welding requires a space into which an electrode is inserted to increase the scale of equipment. In addition, as described above, a decrease in welding portion mechanical strength in pressure-bonding of a terminal caused by a decrease in thickness of a material caused by pressure welding is concerned. However, laser welding serving as non-contact welding can be performed in atmospheric air, and compact equipment can be achieved.

In particular, when fiber laser welding is performed as laser welding, welding with a large depth of fusion can be easily performed. This will be described in more detail. Since a fiber laser has high beam quality and excellent light condensing properties, high-output density processing can be achieved. Thus, by high-aspect-ratio welding in a large depth of fusion, a reliable welding state can be efficiently maintained without giving an excessive thermal influence to a material.

The fiber laser includes a fiber laser beam obtained by continuous oscillation, pulse oscillation, or QCW oscillation or a fiber laser beam that is pulse-controlled and continuously oscillated.

As the pressure-bonding section configuring member 40A, as shown in FIG. 17B, after the pressure-bonding section configuring member 40A is configured, when the pressure-bonding section configuring member 40A and the terminal connection section configuring member 20A are integrally connected in series with each other to configure the female crimp terminal 10, the rear end Xb of the pressure-bonding section configuring member 40A in the long length direction X may be in any one of a state in which the rear end Xb is still attached to a belt-like carrier K and a state in which the rear end Xb is separated from the belt-like carrier K.

Furthermore, with respect to the pressure-bonding section configuring member 40A, insertion of the wire tip 200*a* of the insulated wire 200 into the wire pressure-bonding section 41 of the pressure-bonding section configuring member 40A to perform pressure-bonding connection may be performed, after the pressure-bonding section configuring member 40A is configured, in any one of a state in which the rear end Xb of the pressure-bonding section configuring member 40A in the long length direction X is still attached to the carrier K and a state in which the rear end Xb is separated from the carrier K, and may be performed before or after integrally connected to the terminal connection section configuring member 20A.

Figure 18A:
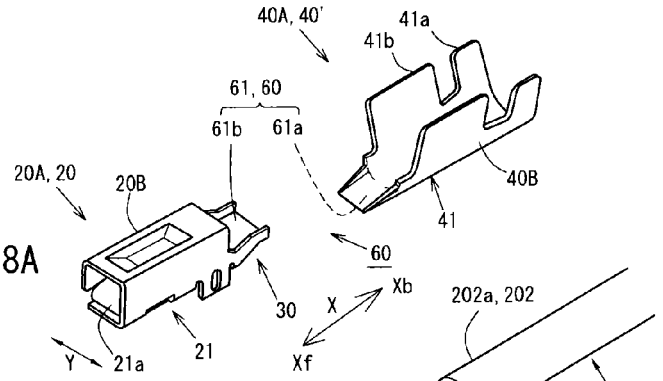
FIGS. 18A to 18C are diagrams for explaining another method of manufacturing a crimp terminal-bearing wire according to still another embodiment.
Figure 18B:
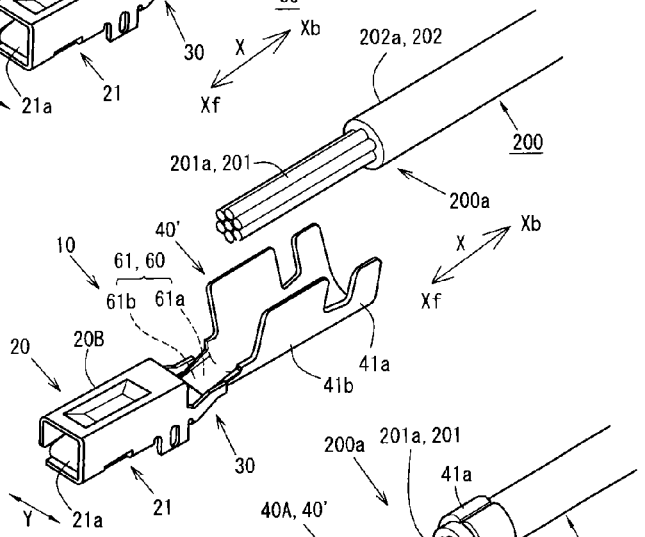
Figure 18C:
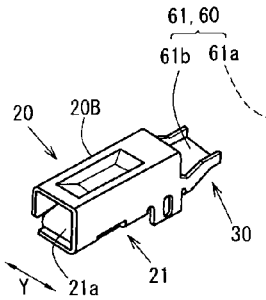

The pressure-bonding section 40 is not limited to the closed-barrel pressure-bonding section described above. As shown in FIG. 18A, as the pressure-bonding section 40, an open-barrel pressure-bonding section may be formed. Furthermore, with respect to an open-barrel pressure-bonding section 40', as shown in FIG. 18B, the pressure-bonding section 40' may be pressure-bonded to the wire tip 200*a* after the pressure-bonding section 40' and the terminal connection section 20 are connected to each other. As shown in FIG. 18C, the pressure-bonding section 40' pressure-bonded to the wire tip 200*a* may be connected to the terminal connection section 20.

FIG. 18A is a diagram for explaining a state in which the open-barrel pressure-bonding section 40' and the terminal connection section 20 are arranged to be opposed to each other before the open-barrel pressure-bonding section 40' and the terminal connection section 20 are connected to each other. FIG. 18B is a diagram for explaining a manner immediately before the female crimp terminal 10 and the wire tip 200*a* are connected to each other in the state in which the open-barrel pressure-bonding section 40' and the terminal connection section 20 are connected to each other. FIG. 18C shows a manner in which the pressure-bonding section 40' to which the wire tip 200*a* is pressure-bonded is connected to the terminal connection section 20.

The above description exemplifies that the pressure-bonding section 40 of the female crimp terminal 10 is pressure-bonded to the aluminum core wire 201 serving as a wire conductor made of an aluminum alloy that is a less noble metal. However, the pressure-bonding section 40 may be pressure-bonded to a wire conductor made of, in addition to the less noble metal such as an aluminum alloy or aluminum, for example, a nobler metal material such as copper or a copper alloy. Almost the same functions and effects as those in the above embodiments can be achieved.

This will be described in more detail. Since the pressure-bonding section 40 having the above configuration can prevent water from entering the pressure-bonding state, for example, the insulated wire 200 configured by a core wire made of copper or a copper alloy that conventionally requires sealing or the like in a post-pressure-bonding state for inter-line waterproof may be connected.

Figure 19A:
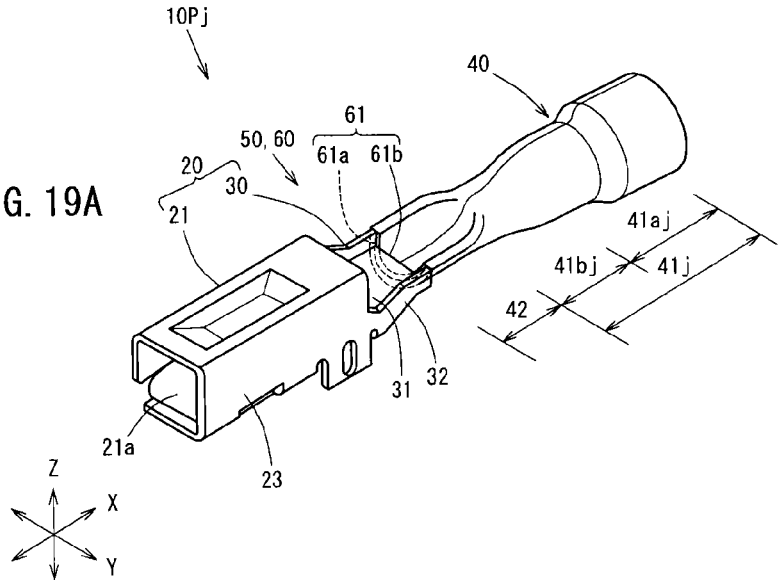
FIGS. 19A and 19B are diagrams for explaining the configuration of a female crimp terminal according to still another embodiment.
Figure 19B:
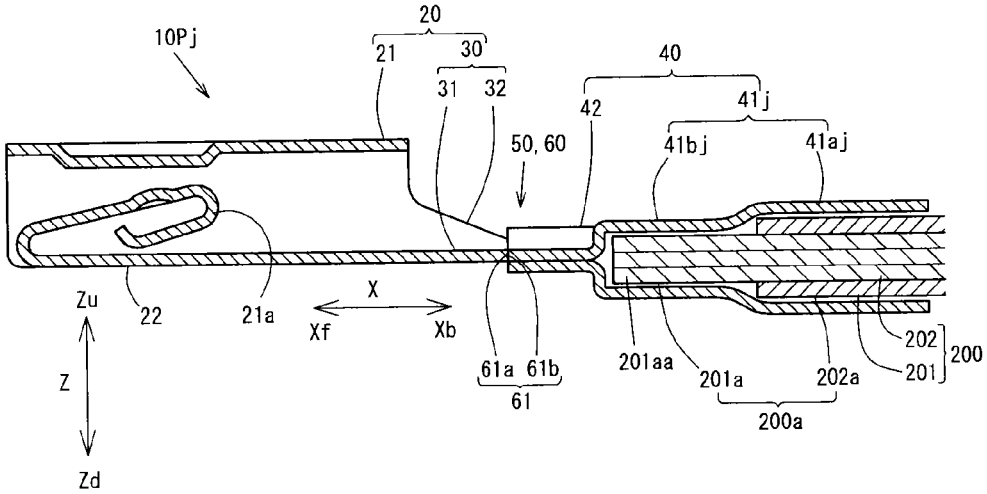

As another embodiment, for example, as in FIGS. 19A and 19B showing a female crimp terminal 10Pj according to another embodiment of the female crimp terminal 10 according to the first embodiment, a wire pressure-bonding section 41*j* may include a configuration in which a conductor pressure-bonding section 41*bj* that pressure-bonds the conductor tip 201*a* and a cover pressure-bonding section 41*aj* that pressure-bonds the insulated tip 202*a* on the tip side of the insulating cover 202 are arranged in the order named from the tip side to the proximal side in the long length direction X.

FIG. 19A is an outside view of the female crimp terminal 10Pj according to the other embodiment, and FIG. 19B is a longitudinal sectional view of the female crimp terminal 10Pj and the wire tip 200*a* inserted into the wire pressure-bonding section 41 *j*, with the wire pressure-bonding section 41 *j* in a pre-pressure-bonding state.

The wire pressure-bonding section 41*j* described above has a configuration in which the cover pressure-bonding section 41*aj* is formed in a hollow shape that can surround the insulated tip 202*a*, the conductor pressure-bonding section 41*bj* is formed to have a diameter smaller than that of the cover pressure-bonding section 41*aj* and formed in a hollow shape that can surround the conductor tip 201*a*, and the conductor pressure-bonding section 41*bj* and the cover pressure-bonding section 41*aj* are formed in hollow shapes continuing along the long length direction X.

According to the configuration described above, in a state in which the wire tip 200*a* is pressure-bonded to the crimp terminal 10, the wire tip 200*a* and the wire pressure-bonding section 41*j* of the female crimp terminal 10Pj can be brought into tight contact with each other to make it possible to obtain stable conductivity.

This will be described in more detail. In the female crimp terminal 10Pj according to the embodiment, as described above, the wire pressure-bonding section 41*j* is configured by the cover pressure-bonding section 41*aj* and the conductor pressure-bonding section 41*bj* formed to have a diameter smaller than that of the cover pressure-bonding section 41*aj*. For this reason, when the wire tip 200*a* is inserted into the wire pressure-bonding section 41*j*, the conductor tip 201*a* can be appropriately arranged on the conductor pressure-bonding section $\mathbf{41}_{bj}$, and the insulated tip 202*a* can be appropriately arranged on the cover pressure-bonding section 41*aj*.

In this manner, in the wire pressure-bonding section 41*j*, the conductor tip 201*a* is not twisted or tilted, and, in the wire pressure-bonding section 41*j*, a useless air space formed by short insertion on the tip side of the conductor tip 201*a* is not left.

Furthermore, in the female crimp terminal 10Pj according to the embodiment, since the conductor pressure-bonding section 41*bj* is formed to have a diameter smaller than that of the cover pressure-bonding section 41*aj* and slightly larger than the outer diameter of the conductor tip 201*a*, when the wire pressure-bonding section 41*j* and the wire tip 200*a* are pressure-bonded, deformation caused by pressure bonding for the conductor pressure-bonding section 41*bj* can be suppressed.

Thus, in the state in which the wire tip 200*a* is pressure-bonded to the wire pressure-bonding section 41*j*, the conductor tip 201*a* and the conductor pressure-bonding section 41*bj* can be tightly connected to each other, and stable conductivity can be obtained.

In addition, as described above, in a state in which the conductor pressure-bonding section 41*bj* is formed to have a diameter smaller than that of the cover pressure-bonding section 41*aj* so as to pressure-bond the wire pressure-bonding section 41*j*, an air space is not formed in the wire pressure-bonding section 41*j*, and the wire pressure-bonding section 41*j* can be prevented from being largely deformed and damaged by the pressure-bonding. For this reason, moisture can be prevented from entering the inside of the wire pressure-bonding section 41*j* and being left in the wire pressure-bonding section 41*j*.

As described above, in the state in which the wire pressure-bonding section 41*j* is pressure-bonded, excellent water-blocking performance in the wire pressure-bonding section 41*j* can be obtained.

Figure 20:
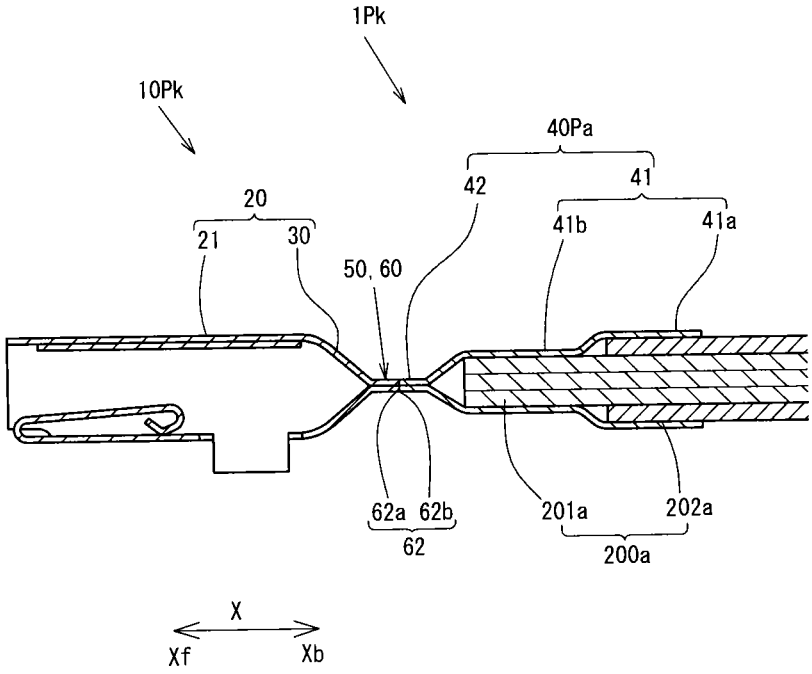
FIG. 20 is a diagram for explaining the configuration of a crimp terminal-bearing wire according to still another embodiment.

As another embodiment, in a female crimp terminal 10Pk, as shown in FIG. 20, the welding connection section 50 is formed at a level higher than those of the bottom surface of the box section 21 and the bottom of the pressure-bonding section 40Pa.

FIG. 20 shows a longitudinal sectional view of a crimp terminal-bearing wire 1Pk according to the other embodiment.

This will be described in more detail. The welding connection section 50, for example, unlike the welding connection section 50 in the second female crimp terminal 1Pa, is not formed on the same plane as those of the bottom surface of the box section 21 and the bottom of the pressure-bonding section 40Pa (see FIG. 6B). The welding connection section 50 is formed at a level of an approximately intermediate portion of the box section 21 and of the pressure-bonding section 40 in the orthogonal direction Z (thickness direction).

As in the configuration described above, when the welding connection section 50 is formed at the level of the approximately intermediate portion of the box section 21 in the orthogonal direction Z (thickness direction), the welding connection section 50 can be reliably shaped in a desired shape in comparison with a case in which the welding connection section 50 is shaped such that the welding connection section 50 is eccentrically located on any one of the bottom side and the upper side in the box section 21 in the thickness direction.

For example, when the terminal connection section configuring member 20A is press-molded by one pair of molds including upper and lower molds, a local tensile load generated by a large change in shape can be avoided from being concentrically applied to a boundary portion between the facing portion (long length direction facing end 62*b*) of the terminal connection section configuring member 20A and the box section 21. For this reason, the terminal connection section configuring member 20A can be reliably shaped in a desired shape without breaking the boundary portion.

Similarly, when the pressure-bonding section configuring member 40A is press-molded by one pair of molds including upper and lower molds, a local tensile load generated by a large change in shape can be avoided from being concentrically applied to a boundary portion between the facing portion (long length direction facing end 62*b*) of the pressure-bonding section configuring member 40A and the pressure-bonding section 40. For this reason, the pressure-bonding section configuring member 40A can be reliably shaped in a desired shape without breaking the boundary portion.

The insulated wire 200 described above can be formed to have a standard outer diameter of 1.4 mm, for example, when the aluminum core wire 201, as described above, is formed to have a section of 0.75 $mm^2$, i.e., a standard outer diameter of 1.0 mm. However, the insulated wire 200 is not limited to the above size, and can be formed with various sizes.

Furthermore, the pressure-bonding section 40 described above can be configured to have various inner diameters depending on the outer diameter of the insulated wire 200 such that, when the wire tip 200*a* is inserted into the pressure-bonding section 40, a gap between the outer diameter of the wire tip 200*a* and the inner peripheral surface of the wire pressure-bonding section 41 is small.

DESCRIPTION OF REFERENCE SIGNS

1, 1Pa, 1Pb, 1Pc, 1Pd, 1Pe, 1Pf, 1Pg, 1Ph, 1Pi, 1Pj, 1Pk: Crimp terminal-bearing wire

10, 10Pa, 10Pb, 10Pc, 10Pd, 10Pe, 10Pf, 10Pg, 10Ph, 10Pi, 10Pj, 10Pk: Female crimp terminal

20, 20Pb, 20Pd, 20Pf, 20Pg, 20Pg: Terminal connection section

40, 40Pa, 40Pb, 40Pd, 40Pe, 40Pf, 40Ph, 40Pi, 40': Pressure-bonding section

42: Sealing portion

50: Welding connection section

60: Facing portion

61 (61*a*, 61*b*), 62 (62*a*, 62*b*), 67 (67*a*, 67*b*), 72 (72*a*, 72*b*): Long length direction facing end

64 (64*a*, 64*b*), 65 (65*a*, 65*b*), 66 (66*a*, 66*b*), 68 (68*a*, 68*b*), 69 (69*a*, 69*b*), 71 (71*a*, 71*b*), 75 (75*a*, 75*b*): Orthogonal direction facing surface

63 (63*a*, 63*b*), 74 (74*a*, 74*b*): Long length direction facing surface

81: Through hole

85: Pressure latching section

86: Latching projecting piece

86*a*: First latching projecting piece

86*b*: Second latching projecting piece

201*a*: Conductor tip

200: Insulated wire
201: Aluminum core wire
202: Insulating cover
Fb: Laser irradiating section
X: Long length direction
Xf: Tip side in long length direction X
Xb: Rear side in long length direction X
Y: Width direction
Z: Orthogonal direction

The invention claimed is:

1. A crimp terminal comprising:

a pressure-bonding section with which at least a conductor tip of an insulated wire is connected by pressure bonding, the insulated wire in which a conductor is covered with an insulating cover and the insulating cover on a tip side is peeled to expose the conductor to obtain the conductor tip; and a terminal connection section to which another connection terminal is allowed to be connected, wherein the pressure-bonding section is configured such that a plate material forms a sectional hollow shape, and the plate material in the sectional hollow shape is welded in a longitudinal direction, on a one-end side of the pressure-bonding section in the longitudinal direction in the sectional hollow shape, a sealing portion that seals the sectional hollow shape to planarly superpose the plate material is arranged, and welding is performed in a width direction between both ends of the sealing portion in the longitudinal direction, the terminal connection section and the pressure-bonding section are configured as different parts, and a welding connection section in which the terminal connection section and the pressure-bonding section are connected by welding in series in the order named from the tip side to a rear side in the longitudinal direction is configured.

2. The crimp terminal according to claim 1, wherein the welding is performed by fiber laser welding.

3. The crimp terminal according to claim 1, wherein at facing portions where the pressure-bonding section and the terminal connection section face each other, orthogonal direction facing surfaces facing each other in an orthogonal direction orthogonal to both the longitudinal direction and the width direction are formed, and the welding connection section is formed such that the orthogonal direction facing surfaces of the pressure-bonding section and the terminal connection section are superposed on each other and the superposed orthogonal direction facing surfaces are welded to each other.

4. The crimp terminal according to claim 3, wherein in the pressure-bonding section, a through hole that penetrates a base material configuring the pressure-bonding section in a thickness direction is formed to make the conductor tip that is pressure-bonded by the pressure-bonding section visible from the outside.

5. The crimp terminal according to claim 4, wherein of the pressure-bonding section in a pressure-bonding state in the circumferential direction, the facing portion facing the terminal connection section is set as the orthogonal direction facing surface, and the through hole is arranged in the orthogonal direction facing surface of the pressure-bonding section.

6. The crimp terminal according to claim 1, wherein at the facing portions where the pressure-bonding section and the terminal connection section face each other, longitudinal direction facing ends facing each other in the longitudinal direction are formed, and the welding connection section is formed such that the longitudinal direction facing ends of the pressure-bonding section and the terminal connection section are made to abut against each other and the abutted longitudinal direction facing ends are welded to each other.

7. The crimp terminal according to claim 6, wherein at the facing portions where the pressure-bonding section and the terminal connection section face each other, the longitudinal direction facing surfaces each having a facing area larger than a facing area between the longitudinal direction facing ends are formed, and the welding connection section is formed such that the longitudinal direction facing surfaces of the pressure-bonding section and the terminal connection section are made to abut against each other and the abutted longitudinal direction facing surfaces are welded to each other.

8. The crimp terminal according to claim 1, wherein at the facing portions where the pressure-bonding section and the terminal connection section face each other, a latching section that latches the facing portions with each other in a facing state is formed, and the welding connection section is formed in a latching state in which the facing portions are latched with each other by the latching section.

9. The crimp terminal according to claim 1, wherein the conductor is made of an aluminum-based material, and at least the pressure-bonding section of the terminal connection section and the pressure-bonding section is made of a copper-based material.

10. A connection structural body wherein the insulated wire and the crimp terminal are connected to each other by the pressure-bonding section in the crimp terminal according to claim 1.

11. A connector wherein the crimp terminal according to claim 1 is arranged in a connector housing.

12. A wire harness wherein the crimp terminal of the connection structural body according to claim 10 is arranged in plural in a connector housing.

13. A method of manufacturing a crimp terminal, the crimp terminal comprising:

a pressure-bonding section with which at least a conductor tip of an insulated wire is connected by pressure bonding, the insulated wire in which a conductor is covered with an insulating cover and the insulating cover on a tip side is peeled to expose the conductor to obtain the conductor tip, and a terminal connection section to which another connection terminal is allowed to be connected, the method comprising:

bending a plate material to configure a sectional hollow shape, and performing shape processing on a one-end side of the sectional hollow shape in a longitudinal direction to have a sealing shape that seals the sectional hollow shape to planarly superpose the plate material, welding ends of the plate material configuring the sectional hollow shape to each other in the longitudinal direction, performing welding in a width direction between both ends in the longitudinal direction of a sealing portion processed to have the sealing shape to configure the pressure-bonding section, arranging the terminal connection section and the pressure-bonding section that are configured as different parts in series in the order named from the tip side to a rear side in a longitudinal direction, and a welding step of integrally welding the terminal connection section and the pressure-bonding section to each other in a state in which the terminal connection section and the pressure-bonding section are connected to each other.

14. The method of manufacturing a crimp terminal according to claim 13, wherein welding for integrally connecting the terminal connection section and the pressure-bonding section to each other and welding performed in the width direction between both the ends of the sealing portion in the longitudinal direction are performed at a time.

15. The method of manufacturing a crimp terminal according to claim 13, wherein the welding step is performed by fiber laser welding.

16. The method of manufacturing a crimp terminal according to claim 15, wherein in the welding step in which longitudinal direction facing ends facing each other in a longitudinal direction are made to abut against each other at facing portions where the pressure-bonding section and the terminal connection section face each other and the abutted longitudinal direction facing ends are welded to each other, the longitudinal direction facing ends are irradiated with the laser from at least one side of the longitudinal direction in the state in which the longitudinal direction facing ends are made to abut against each other, and welding in which the longitudinal direction facing ends are irradiated with the laser from a direction approximately equal to the longitudinal direction is performed while at least one of the laser and the longitudinal direction facing ends is relatively moved to move the laser along the longitudinal direction facing ends.

17. A method of manufacturing a connection structural body, the method comprising:

a pressure-bonding step of connecting the conductor tip to the pressure-bonding section by pressure bonding performed before the welding step performed in the method of manufacturing a crimp terminal according to claim 13.

* * * * *